US008165508B2

(12) United States Patent
Matsumoto et al.

(10) Patent No.: US 8,165,508 B2
(45) Date of Patent: Apr. 24, 2012

(54) DEVELOPER LOADING METHOD, LOADED DEVELOPER ACCOMMODATING CONTAINER, DEVELOPER REPLENISHMENT DEVICE, AND IMAGE FORMING APPARATUS

(75) Inventors: Keiko Matsumoto, Kanagawa (JP); Emi Kita, Tokyo (JP); Mugijirou Uno, Kanagawa (JP); Satoru Miyamoto, Kanagawa (JP); Junichi Terai, Kanagawa (JP); Maiko Koeda, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 1056 days.

(21) Appl. No.: 12/020,713

(22) Filed: Jan. 28, 2008

(65) Prior Publication Data

US 2008/0181630 A1 Jul. 31, 2008

(30) Foreign Application Priority Data

Jan. 30, 2007 (JP) ..... 2007-019395

(51) Int. Cl.
*G03G 15/08* (2006.01)

(52) U.S. Cl. ..... 399/259; 399/258

(58) Field of Classification Search ..... 399/258–259
See application file for complete search history.

(56) References Cited

U.S. PATENT DOCUMENTS

| | | | |
|---|---|---|---|
| 5,475,478 | A | 12/1995 | Nishimura et al. |
| 5,699,842 | A | 12/1997 | Wegman |
| 7,184,691 | B2 | 2/2007 | Kita et al. |
| 7,272,354 | B2 | 9/2007 | Murakami et al. |
| 2005/0277046 | A1 | 12/2005 | Sawada et al. |
| 2006/0057479 | A1 | 3/2006 | Niimi et al. |
| 2006/0093946 | A1 | 5/2006 | Miyamoto et al. |
| 2006/0099009 | A1 | 5/2006 | Miyamoto et al. |
| 2006/0120767 | A1 | 6/2006 | Miyamoto et al. |
| 2006/0127152 | A1 | 6/2006 | Nagayama et al. |
| 2006/0134540 | A1 | 6/2006 | Kondo et al. |
| 2006/0154168 | A1 | 7/2006 | Tomita et al. |
| 2006/0177749 | A1 | 8/2006 | Tamoto et al. |
| 2006/0222987 | A1 | 10/2006 | Suzuki et al. |
| 2007/0020546 | A1 | 1/2007 | Emoto et al. |
| 2007/0077098 | A1 | 4/2007 | Katsuyama et al. |
| 2007/0116494 | A1 | 5/2007 | Uno et al. |
| 2007/0122204 | A1 | 5/2007 | Kita |
| 2007/0140747 | A1 | 6/2007 | Kita et al. |
| 2007/0140749 | A1 | 6/2007 | Miyamoto et al. |

(Continued)

FOREIGN PATENT DOCUMENTS

EP 1621478 2/2006

(Continued)

OTHER PUBLICATIONS

U.S. Appl. No. 12/182,626, filed Jul. 30, 2008, Terai.

(Continued)

*Primary Examiner* — David Gray
*Assistant Examiner* — Andrew Do
(74) *Attorney, Agent, or Firm* — Oblon, Spivak, McClelland, Maier & Neustadt, L.L.P.

(57) ABSTRACT

A method for loading a replenishment developer into a developer accommodating container such that when the replenishment of the replenishment developer inside the loaded developer accommodating container is started, the developer composed of a toner and a carrier, or a toner is discharged from a developer discharge port of the developer accommodating container, wherein when a premix toner that is a replenishment developer composed of a replenishment toner and a replenishment carrier is loaded into a toner bottle serving as the developer accommodating container, the replenishment carrier is loaded and then the replenishment toner is loaded.

11 Claims, 11 Drawing Sheets

U.S. PATENT DOCUMENTS

| | | | |
|---|---|---|---|
| 2007/0212119 | A1 | 9/2007 | Kurenuma et al. |
| 2007/0280742 | A1 | 12/2007 | Matsumoto et al. |

FOREIGN PATENT DOCUMENTS

| | | |
|---|---|---|
| JP | 2001-324863 | 11/2001 |
| JP | 2002-2832 | 1/2002 |
| JP | 2003-57863 | 2/2003 |
| JP | 2004-29306 | 1/2004 |
| JP | 2004-264510 | 9/2004 |
| JP | 2004-323062 | 11/2004 |
| JP | 2004-333514 | 11/2004 |
| JP | 2005099643 | 4/2005 |
| JP | 2006-184918 | 7/2006 |

OTHER PUBLICATIONS

U.S. Appl. No. 12/194,649, filed Aug. 20, 2008, Kita, et al.
U.S. Appl. No. 12/235,135, Sep. 22, 2008, Kato, et al.
U.S. Appl. No. 12/238,815, Sep. 26, 2008, Utsunomiya, et al.
U.S. Appl. No. 12/246,027, filed Oct. 6, 2008, Uno, et al.
U.S. Appl. No. 12/253,538, filed Oct. 17, 2008, Uno, et al.
Office Action issued May 13, 2011 in Japanese Patent Application No. 2007-019395.

FIG. 9

| | IN THE VICINITY OF DISCHARGE PORT | | IN THE VICINITY OF CONTAINER BOTTOM | |
|---|---|---|---|---|
| | CARRIER CONCENTRATION (wt.%) | ATTACHMENT STATE | CARRIER CONCENTRATION (wt.%) | ATTACHMENT STATE |
| REPLENISHMENT TONER ACCOMMODATING CONTAINER A | 0.0 | - | 97.0 | × |
| REPLENISHMENT TONER ACCOMMODATING CONTAINER B | 0.0 | - | 56.8 | O |
| REPLENISHMENT TONER ACCOMMODATING CONTAINER C | 94.7 | × | 0.3 | O |
| REPLENISHMENT TONER ACCOMMODATING CONTAINER D | 0.4 | O | 91.4 | O |
| REPLENISHMENT TONER ACCOMMODATING CONTAINER E | 1.2 | O | 62.4 | O |

FIG. 10

| | CONCENTRATION OF CARRIER IN REPLENISHMENT DEVELOPER (wt.%) | | RESIDUE AFTER THE DISCHARGE OF REPLENISHMENT DEVELOPER IS STOPPED | |
|---|---|---|---|---|
| | WHEN 1/4 AMOUNT IS DISCHARGED | WHEN 3/4 AMOUNT IS DISCHARGED | AMOUNT OF DEVELOPER (g) | AMOUNT OF CARRIER (g) |
| EXAMPLE 1 | 6.7 | 14.2 | 5.5 | 0.5 |
| EXAMPLE 2 | 16.2 | 12.5 | 4.6 | 0.3 |
| COMPARATIVE EXAMPLE 1 | 57.3 | 2.3 | 4.2 | 0.1 OR LESS |
| EXAMPLE 3 | 12.8 | 13.3 | 3.7 | 0.1 OR LESS |
| COMPARATIVE EXAMPLE 2 | - | - | 443.1 | 22.6 |
| EXAMPLE 4 | 3.3 | 23.7 | 3.4 | 0.1 OR LESS |
| EXAMPLE 5 | 12.0 | 9.1 | 3.4 | 0.1 OR LESS |

FIG. 11

| | INITIAL | | | AFTER 100,000 PRINTOUTS | | |
|---|---|---|---|---|---|---|
| | IMAGE DENSITY | BACKGROUND STAINING | TRANSFERABILITY | IMAGE DENSITY | BACKGROUND STAINING | TRANSFERABILITY |
| EXAMPLE 1 | 5 | 5 | 5 | 4 | 5 | 4 |
| EXAMPLE 2 | 5 | 5 | 5 | 5 | 5 | 5 |
| COMPARATIVE EXAMPLE 1 | 5 | 5 | 5 | 4 | 3 | 2 |
| EXAMPLE 3 | 5 | 5 | 5 | 5 | 4 | 4 |
| COMPARATIVE EXAMPLE 2 | NOT EVALUATED | NOT EVALUATED | NOT EVALUATED | NOT EVALUATED | NOT EVALUATED | NOT EVALUATED |
| EXAMPLE 4 | 5 | 5 | 5 | 5 | 5 | 4 |
| EXAMPLE 5 | 5 | 5 | 5 | 5 | 5 | 5 |

DEVELOPER LOADING METHOD, LOADED DEVELOPER ACCOMMODATING CONTAINER, DEVELOPER REPLENISHMENT DEVICE, AND IMAGE FORMING APPARATUS

BACKGROUND OF THE INVENTION

1. Field of the Invention

The present invention relates to a developer loading method for loading a replenishment developer containing a toner and a carrier into a developer accommodating container and to a developer accommodating container into which the developer is loaded by the developer loading method. The present invention also relates to a developer replenishment device comprising the developer accommodating container and an image forming apparatus. Furthermore, the present invention relates to a method for manufacturing a loaded developer accommodating container that is loaded with a replenishment developer containing a toner and a carrier and to a method for supplying the developer from the loaded developer accommodating container into a development device.

2. Description of the Related Art

In a conventional image forming apparatus using a two-component developer containing a toner and a carrier, because the toner inside the development device is consumed, a replenishment toner accommodating unit is provided for accommodating a replenishment toner that is supplied to the development device.

Following a transition to full-color images in the image forming apparatuses, even higher image quality is now required, and the size of toner particles used in the image forming apparatus is decreased to meet such a requirement. Due to the decrease in size of toner particles, the surface area of the toner increases and the toner component is easily spent on the carrier. Further, as the size of the image forming apparatuses decreases and speed thereof increases, high speed rotation proceeds inside the development device with a small amount of developer. As a result, the stresses applied to the developer increase and the deterioration of carrier is readily accelerated by the removal of the carrier coating film and toner spent. With the developer using such deteriorated carrier, high-quality images are difficult to obtain even when the toner has a small particle size. In a configuration in which a replenishment toner is supplied to the development device, the replenishment toner is supplied, while the toner inside the development device is consumed by the development process. Therefore, the toner inside the development device is replaced, but the carrier inside the development device is not replaced. As a result, in order to inhibit the degradation of image quality caused by carrier deterioration it is necessary to replace frequently the developer inside the development device. However, frequent replacement of the developer inside the development device leads to the increased maintenance cost and rises the printout unit cost.

An image forming apparatus described in Japanese Examined Patent Application No. 60-18065 (Prior Art 1) is an example of a configuration in which the degradation of image quality caused by carrier deterioration inside the development device can be inhibited, while inhibiting the increase in maintenance cost. In the image forming apparatus described in Prior Art 1, a replenishment carrier is periodically and automatically supplied independently of the replenishment toner. Further, the carrier inside the development device is replaced by discharging the developer in an amount corresponding to that of the supplied replenishment carrier from the development device. As a result, the ratio of the deteriorated carrier in the entire carrier present in the development apparatus can be reduced and the degradation of image quality caused by carrier deterioration inside the development apparatus can be inhibited. Because the ratio of the deteriorated carrier in the entire carrier present in the development apparatus can be reduced, the replacement frequency of the developer inside the development device can be decreased and the increase in the maintenance cost can be inhibited.

However, in the configuration described in Prior Art 1, an accommodation unit that accommodates the replenishment carrier has to be provided separately from the replenishment toner accommodating unit that accommodates the replenishment toner, and a replenishment device has to be provided separately from the replenishment device that supplies the replenishment toner. As a result, the image forming apparatus is increased in size and cost thereof rises.

An image forming apparatus described in Japanese Unexamined Patent Application No. 2004-29306 (Prior Art 2) is another example of a configuration in which the degradation of image quality caused by carrier deterioration inside the development device can be inhibited, while inhibiting the increase in maintenance cost. The image forming apparatus described in Prior Art 2 comprises a developer accommodating container that accommodates a premix toner that is a developer obtained by mixing a replenishment carrier with a replenishment toner and having a toner concentration higher than that of the developer inside the development device, and this premix toner is supplied to the development device. Further, the replacement of carrier inside the development device is performed by discharging the developer in an amount corresponding to that of the supplied premix toner from the development device. In this image forming device, because the premix toner is supplied, it is not necessary to provide an accommodating container and a replenishment device for the replenishment toner and replenishment carrier. As a result, the increase inside and cost of the device can be inhibited with respect to those of the image forming apparatus of Prior Art 1.

On the other hand, Japanese Unexamined Patent Application No. 2004-323062 (Prior Art 3) describes a toner replenishment device that supplies a replenishment toner into a development device, wherein the replenishment toner located in the replenishment toner accommodating container is sucked in by a negative pressure created by a powder pump, and the replenishment toner that has been sucked in is conveyed into the development device. The toner replenishment device of Prior Art 3 comprises inside thereof a conveying path member through which the replenishment toner passes and a powder pump, and the replenishment toner located in the vicinity of the toner discharge port of the replenishment toner accommodating container is discharged from the toner discharge port by the negative pressure created by the suction force of the powder pump. The replenishment toner that has been discharged from the toner discharge port passes inside the conveying path member and is conveyed to the development device, whereby the replenishment toner is supplied to the development device. Further, when the replenishment toner located in the vicinity of the toner discharge port is discharged toward the development device by the negative pressure, the replenishment toner that is not located in the vicinity of the toner discharge port is moved toward the toner discharge port by the discharge of the toner located in the vicinity of the toner discharge port to the outside. With such toner replenishment device, the discharge of replenishment toner and the movement of replenishment toner inside the toner accommodating body are performed by the suction action of the powder pump. As a result, a toner conveying member serving to move the replenishment toner into the toner accommodating body becomes unnecessary.

As described hereinabove, in the image forming apparatus of Prior Art 3, the replenishment toner is accommodated in the toner accommodating container, and the replenishment toner is supplied into the development device by the toner replenishment device comprising a powder pump. The results of the comprehensive study conducted by the inventors demonstrated that a developer containing a toner and a carrier, as in the developer accommodating container described in Prior Art 2, can be accommodated in the toner accommodating container of the image forming apparatus described in Prior Art 3, and this developer can be supplied to the development device by the negative pressure of a powder pump.

Further, the test performed by the six inventors of the present invention demonstrated that the following drawbacks are associated with the configuration in which a developer is supplied to the development device by the negative pressure of a powder pump. Thus, with a developer containing a toner and a carrier, the developer can be conveyed by the negative pressure of a powder pump, but when the carrier alone is conveyed, the conveyance with the powder pump stops. Where the conveyance of the carrier with the powder pump stops, the carrier clogs the conveying path member and cannot be moved even by the application of negative pressure.

As described above, in the toner accommodating container of Prior Art 3, no toner conveying member is required for transferring the replenishment toner into the toner accommodating body. Therefore, the toner accommodating container is not provided with the toner conveying member. Further, where the developer accommodating container is obtained by accommodating a developer inside an accommodating container identical to the toner accommodating container, the developer accommodating container does not contain a developer conveying member for conveying the developer inside the developer accommodating body. Where such a developer accommodating container is set into a developer replenishment device, because no developer conveying member is provided inside the developer accommodating body, the developer inside the developer accommodating body practically does not move within the interval after the developer accommodating container has been set and before the replenishment of the developer is started. Therefore, depending on a developer loading method, the carrier can be unevenly distributed inside the developer accommodating container and it is possible that the carrier alone will be discharged from the developer discharge port of the developer accommodating container when the developer supply is started.

Further, where the carrier alone is discharged from the developer discharge port, the carrier alone is conveyed by the powder pump, and the conveyance of the developer by the powder pump is stopped. On the other hand, where the developer containing the carrier and toner or the toner alone is discharged from the developer discharge port, the developer can be continuously conveyed by the powder pump.

Even with the developer accommodating container containing no developer conveying member inside the developer accommodating body, the developer is moved inside the developer accommodating container by discharging the developer from the developer discharge port. Due to loading of the developer, the carrier is non-uniformly distributed inside the developer container and even the carrier that has not come into contact with the toner is gradually brought into contact with the toner by the movement of the developer inside the developer accommodating container. Further, because the carrier that has once come into contact with the toner can hardly assume again a state in which it has no contact with the toner, when the carrier is discharged from the developer discharge port, the carrier is discharged in a mixture with the toner. Therefore, if the carrier alone is not discharged when the replenishment is started, even if a region in which only the carrier is present exists inside the developer accommodating container, no serious problem is associated therewith.

However, before the replenishment is started, the movement of the developer inside the developer accommodating container that accompanies the discharge of the developer is not performed. Therefore, in a loading state in which the carrier alone is discharged when the replenishment is started, the operation of conveying the developer with the powder pump is stopped, as described hereinabove.

Technologies relating to the present invention are also disclosed in, e.g., Japanese Patent Application No. 2004-15276.

SUMMARY OF THE INVENTION

The present invention was created to resolve the above-described problems and it is an object of the present invention to provide a developer loading method for loading a replenishment developer into a developer accommodating container so that the developer containing a toner and a carrier or the toner is discharged from the developer discharge port of the developer accommodating container when the replenishment of the replenishment developer inside the developer accommodating container after loading is started.

Further, another object of the present invention is to provide a loaded developer accommodating container into which the replenishment developer has been loaded by the developer loading method, a developer replenishment device using the loaded developer accommodating container, and an image forming apparatus equipped with the developer replenishment device.

Yet another object of the present invention it to provide a developer replenishment method by which the developer or toner is discharged from the developer discharge port of the developer accommodating container when the replenishment of the loaded developer accommodating container is started.

Still another object of the present invention is to provide a method for manufacturing a loaded powder accommodating container in which the developer or toner is discharged from the developer discharge port of the developer accommodating container when the replenishment is started.

In an aspect of the present invention, a developer loading method loads a replenishment developer comprising a toner and a carrier into a developer accommodating container which is used in a developer replenishment device for conveying a developer by an attraction force and which has a developer accommodating body that accommodates the replenishment developer; and a developer discharge port for discharging the replenishment developer from inside the developer accommodating body to the outside. The replenishment developer is loaded into the developer accommodating container in a state in which the replenishment developer located in the vicinity of the developer discharge port of the developer accommodating container after the replenishment developer has been loaded is not composed only of the carrier.

In another aspect of the present invention, a loaded developer accommodating container is used in a developer replenishment device for conveying a developer by an attraction force and comprises a developer accommodating body that is loaded with a replenishment developer comprising a toner and a carrier; and a developer discharge port for discharging the replenishment developer from inside the developer accommodating body to the outside. The replenishment developer accommodated in the developer accommodating body is loaded into the developer accommodating container in a state in which the replenishment developer located in the vicinity of the developer discharge port of the developer accommodating container after the replenishment developer has been loaded is not composed only of the carrier.

In another aspect of the present invention, an image forming apparatus comprises a latent image carrying body; a development device that develops the latent image located on the latent image carrying body by using a developer inside a developer accommodation unit; and a developer replenishment device for supplying the developer to the developer accommodation unit. The developer replenishment device comprises a developer accommodation device for accommodating a replenishment developer comprising a toner and a carrier; and a developer conveying device for conveying the replenishment developer to a conveying destination. The developer conveying means comprises a conveying path member in which the replenishment developer passes; and a powder pump that causes a negative pressure to act upon the replenishment developer of the developer accommodation means and moves the replenishment developer through the conveying path member toward the conveying destination of the replenishment developer. The developer accommodation device comprises a developer accommodating body that is loaded with the replenishment developer comprising a toner and a carrier; and a developer discharge port for discharging the replenishment developer from inside the developer accommodating body to the outside. The replenishment developer accommodated in the developer accommodating body is loaded into the developer accommodating container in a state in which the replenishment developer located in the vicinity of the developer discharge port of the developer accommodating container after the replenishment developer has been loaded is not composed only of the carrier.

BRIEF DESCRIPTION OF THE DRAWINGS

The above and other objects, features and advantages of the present invention will become more apparent from the following detailed description taken with the accompanying drawings in which:

FIG. 9 is a table illustrating the measurement results obtained in measuring the carrier concentration in the vicinity of the toner discharge port of the toner bottle and the vicinity of the container bottom and also the attachment state of the carrier and toner;

FIG. 10 is a table showing the results obtained in evaluating the carrier replenishment ability; and FIG. 11 is a table showing the results obtained in evaluating the multiple sheet output.

DESCRIPTION OF THE PREFERRED EMBODIMENTS

An embodiment of a color laser copier (referred to hereinbelow simply as "copier") in which a plurality of photosensitive bodies are disposed in a row will be explained below as an image forming apparatus employing the present invention.

Figure 1:
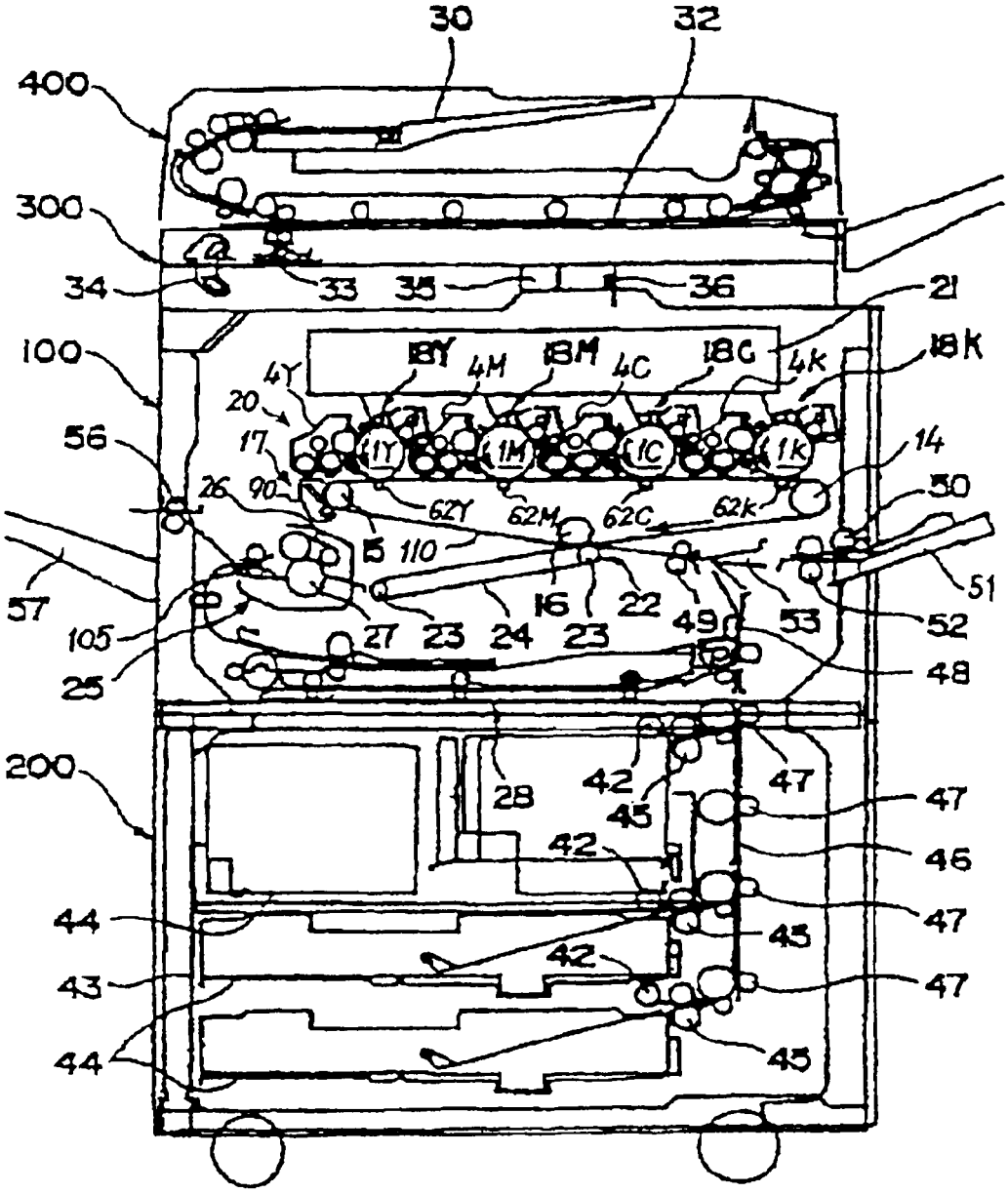
FIG. 1 shows a schematic configuration of the copier of the embodiment of the present invention.

FIG. 1 is a schematic structural view of the copier of the present embodiment. The copier comprises a printer unit 100, a paper feed device 200 that carries the printer unit, and a scanner 300 fixed on the printer unit 100. A manuscript automatic conveying device 400 fixed on the scanner 300 is also provided.

The printer unit 100 comprises an image forming unit 20 composed of four process cartridges 18Y, M, C, K for forming images of yellow (Y), magenta (M), cyan (C), and black (K) colors. The letters Y, M, C, K assigned after the number in each reference symbol indicate the members for yellow, cyan, magenta, and black, respectively (same hereinbelow). A photo-writing unit 21, an intermediate transfer unit 17, a secondary transfer device 22, a resist roller pair 49, and a fixing device 25 of a belt fixing system are installed in addition to the process cartridges 18Y, M, C, K.

The photo-writing unit 21 has a light source, a polygon mirror, an f-θ lens, and a reflective mirror (not shown in the figure) and irradiates the surface of the below-described photosensitive body with a laser beam based on the image data.

The process cartridges 18Y, M, C, K have a drum-like photosensitive body 1, a charging device, a development device 4, a drum cleaning device, and a neutralization device. The process cartridge 18 for yellow color will be described below.

The surface of the photosensitive body 1Y is uniformly charged with the charging device serving as charging means. The surface of the photosensitive body 1Y that has been subjected to charging treatment is irradiated with a laser beam that has been modulated and deflected by the photo-writing unit 21. Accordingly, the electric potential of the irradiated zones (exposed zones) is reduced. As a result of such potential reduction, an electrostatic latent image for Y is formed on the surface of the photosensitive body 1Y. The electrostatic latent image for Y that has thus been formed is developed with a development device 4Y serving as a development means and becomes an Y toner image.

The Y toner image formed on the photosensitive body 1Y for Y is primary transferred on the below-described intermediate transfer belt 110. The toner remaining after the transfer is cleaned from the surface of the photosensitive body 1Y after the primary transfer with the drum cleaning device.

The electric charge of the photosensitive body 1Y that has been cleaned with the drum cleaning device in the process cartridge 18Y for Y is neutralized with the neutralization device. Then, the photosensitive body is again uniformly charged with the charging device and returned to the initial state. Such series of process steps are also implemented in other process cartridges 18M, C, K.

The intermediate transfer unit will be described below.

The intermediate transfer unit 17 has an intermediate transfer belt 110 and a belt cleaning device 90. The intermediate transfer unit also has a tension roller 14, a drive roller 15, a secondary transfer backup roller 16, and four primary transfer bias rollers 62Y, M, C, K.

The intermediate transfer belt 110 is tensioned with a plurality of rollers including the tension roller 14. Then, the intermediate transfer belt is moved clockwise in an endless fashion, as shown in the figure, by the rotation of the drive roller 15 that is driven by a belt drive motor (not shown in the figure).

The four primary transfer bias rollers 62Y, M, C, K are disposed so as to be in contact with the inner peripheral surface side of the intermediate transfer belt 110 and receive the application of a primary transfer bias from a power source (not shown in the figure). The intermediate transfer belt 110 is also pressed from the inner peripheral surface side thereof toward the photosensitive bodies 1Y, M, C, K to form the respective primary transfer nips. A primary transfer electric field is formed between the photosensitive body 1 and the primary transfer bias roller 62 under the effect of the primary transfer bias in each primary transfer nip.

The aforementioned Y toner image that has been formed on the photosensitive body 1Y for Y is primary transferred onto the intermediate transfer belt 110 under the effect of the primary transfer electric field and nip pressure. The M, C, K toner images formed on the photosensitive bodies 1M, C, K for M, C, K are primary transferred with successive superposition on the Y toner image. With such superposition primary transfer, a four-color superimposed toner image (referred hereinbelow as "four-color toner image") composed of multiple toner images is formed on the intermediate transfer belt 110.

The four-color toner image that has been transferred with superposition onto the intermediate transfer belt 110 is then secondary transferred on transfer paper serving as a recording body (not shown in the figure) in the below-described secondary transfer nip. The toner remaining on the surface of the intermediate transfer belt 110 after it has passed through the secondary transfer nip is cleaned with the belt cleaning device 90 that, together with the drive roller 15 shown on the left side in the figure, sandwiches the belt.

The secondary transfer device 22 will be described below.

The secondary transfer device 22 in which a paper conveying belt 24 is tensioned by two tension rollers 23 is installed below (as shown in the figure) the intermediate transfer unit 17. The paper conveying belt 24 moves in an endless fashion counterclockwise (as shown in the figure) following the rotary drive of at least any one tension roller 23. From among the two tension rollers 23, the tension roller 23 that is disposed on the right side, as shown in the figure, together with the secondary transfer backup roller 16 of the intermediate transfer unit 17 sandwiches the intermediate transfer belt 110 and paper conveying belt 24. Because of such sandwiching, a secondary transfer nip is formed in which the intermediate transfer belt 110 of the intermediate transfer unit 17 comes into contact with the paper conveying belt 24 of the secondary transfer device 22. A secondary transfer bias of a polarity opposite that of the toner is applied with a power source (not shown in the figure) to this tension roller 23. Due to the application of the secondary transfer bias, a secondary transfer electric field is formed in the secondary transfer nip, this electric field electrostatically moves the four-color toner image located on the intermediate transfer belt 110 of the intermediate transfer unit 17 from the belt toward the tension roller 23. The four-color toner image that is thus affected by the secondary transfer electric field and nip pressure is secondary transferred onto the transfer paper that is fed into the secondary transfer nip so as to be synchronized with the four-color toner image located on the intermediate transfer belt 110 by the below-described resist roller pair 49. Further, instead of the above-described secondary transfer system in which the secondary transfer bias is applied to one tension roller 23, a charger may be provided for charging the transfer paper in a contactless manner.

In a paper feed device 200 provided in the lower portion of the copier body, a plurality of paper feed cassettes 44 that can accommodate inside thereof a plurality of stacks, each containing a plurality of transfer paper sheets, are disposed by stacking in the vertical direction. In each paper feed cassette 44, a paper feed roller 42 is pressed against the uppermost transfer paper sheet in the paper stack. The uppermost transfer paper sheet is fed toward the paper feed path 46 by rotating the paper feed roller 42.

The paper feed path 46 that received the transfer paper that has been fed from the paper feed cassette 44 has a plurality of conveying roller pairs 47 and a resist roller pair 49 provided in the vicinity of the path end inside the path. The transfer paper is conveyed toward the resist roller pair 49. The transfer part that has been conveyed toward the resist roller pair 49 is inserted between the rollers of the resist roller pair 49. On the other hand, the four-color toner image that has been formed on the intermediate transfer belt 110 in the intermediate transfer unit 17 advances in the secondary transfer nip, following the endless rotation of the belt. The resist roller pair 49 feeds out the transfer paper that has been inserted between the rolls at a timing such that the transfer paper can be brought into intimate contact with the four-color toner image in the secondary transfer nip. As a result, the four-color toner image located on the intermediate transfer belt 110 is brought into intimate contact with the transfer paper in the secondary transfer nip. The four-color toner image is then secondary transferred onto the transfer paper and a full-color image is obtained on the white transfer paper. The transfer paper where the full-color image has thus been formed exits the secondary transfer nip, following the endless movement of the paper conveying belt 24, and is sent from above the paper conveying belt 24 to the fixing device 25.

The fixing device 25 comprises a belt unit in which the fixing belt 26 performs endless movement, while being tensioned by two rollers, and a pressure roller 27 that is pressed against one roller of the belt unit. These fixing belt 26 and pressure roll 27 are brought into contact with each other, thereby forming a fixing nip, and the transfer paper that has been received from the paper conveying belt 24 is inserted into the fixing nip. From among the two rollers of the belt unit, the roller to which a pressure is applied by the pressure roller 27 has a heat source (not shown in the figure) inside thereof, and because of the heat generated thereby, a pressure is applied to the fixing belt 26. The fixing belt 26 to which the pressure has thus been applied heats the transfer paper that has been inserted into the fixing nip. The full-color image is fixed to the transfer paper under the effect of this heating or nip pressure.

The transfer paper subjected to the above-described fixing treatment inside the fixing device 25 is stacked on the stack unit 57 provided outside the plate on the left side (as shown in the figure) of the printer casing, or returned to the above-described secondary transfer nip for forming a toner image on the other side.

When a manuscript (not shown in the figure) is to be copied, for example, a stack of sheets of the manuscript is set on a manuscript stand 30 of the manuscript automatic conveying device 400. When the manuscript is in the form of a book that is bound on one side, it is set onto a contact glass 32. Prior to such setting, the manuscript automatic conveying device 400 is opened with respect to the copier body and the contact glass 32 of the scanner 300 is exposed. Then, the closed manuscript automatic conveying device 400 applies pressure to the manuscript bound on one side.

Where a copy start switch (not shown in the figure) is pushed after the manuscript has thus been set, the manuscript read operation with the scanner 300 is started. When a sheet manuscript is set in the manuscript automatic conveying device 400, the manuscript automatic conveying device 400 automatically moves the sheet manuscript to the contact glass 32 prior to the manuscript read operation. In the manuscript read operation, a first traveling body 32 and a second traveling body start 34 moving together, and light is emitted from a light source provided at the first traveling body 33. The light reflected from the manuscript surface is then reflected by a mirror provided on the second traveling body 34, passes through an image forming lens 35, and then falls onto a read sensor 36. The read sensor 36 creates image information based on the incident light.

Various devices located in the process cartridges 18Y, M, C, K or the intermediate transfer unit 17, secondary transfer device 22, and fixing device 25 start respective operations in parallel with such manuscript read operations. The photowriting unit 21 is driven and controlled based on the image information created by the read sensor 36, and Y, M, C, K toner images are formed on the photosensitive bodies 1Y, M, C, K. These toner images serve as four-color toner images transferred with superposition onto the intermediate transfer belt 110.

A paper feed operation is started in the paper feed device 200 almost simultaneously with the start of the manuscript read operation. In the paper feed operation, one of the paper feed rollers 42 is selectively rotated and transfer paper is fed out from one of the paper feed cassettes 44 that are accommodated in a multistage fashion inside the paper bank 43. The sheets of the transfer paper that have been fed out are separated with a separation roller 45 and introduced into a reverse paper feed path 46 and then conveyed toward the secondary transfer nip with a conveying roller pair 47. Instead of such paper feed from the paper feed cassette 44, the paper is sometimes fed from a manual tray 51. In this case, a manual paper feed roller 50 is selectively rotated, the transfer paper located on the manual tray 51 is fed out and the sheets of transfer paper are separated one by one with a separation roller 52 and fed to the manual paper feed path 53 of the printer unit 100.

When images of other colors that are composed of toners of two or more colors are formed in the copier, the intermediate transfer belt 110 is stretched in a state in which the upper tensioned surface thereof is almost horizontal and all the photosensitive bodies 1Y, M, C, K are brought into contact with the upper tensioned surface. By contract, when a monochromatic image composed only of the K toner is formed, the intermediate transfer belt 110 is tilted down and to the left, as shown in the figure, and the upper tensioned surface thereof is withdrawn from the photosensitive bodies 1Y, M, C for Y, M, C. Then, only the photosensitive body 1K for K, from among the four photosensitive bodies 1Y, M, C, K, is rotated counterclockwise, as shown in the figure, and only a K toner image is produced. In this case, the operation of not only the photosensitive bodies 1, but also of the developing unit is stopped with respect to Y, M, C, thereby preventing the unnecessary consumption of the photosensitive body and developer.

The copier comprises a control unit (not shown in the figure) composed of a CPU or the like that controls the below-described devices located inside the copier and an operation display unit (not shown in the figure) that is composed of a liquid-crystal display and various key buttons. By performing key input operations on the operation display unit, the operator sends a command to the control unit, whereby one of the three modes can be selected for a single-side print mode that is a mode of forming an image only on one side of the transfer paper. These three single-side print modes are a direct discharge mode, a reverse discharge mode, and a reverse decal discharge mode.

Figure 2:
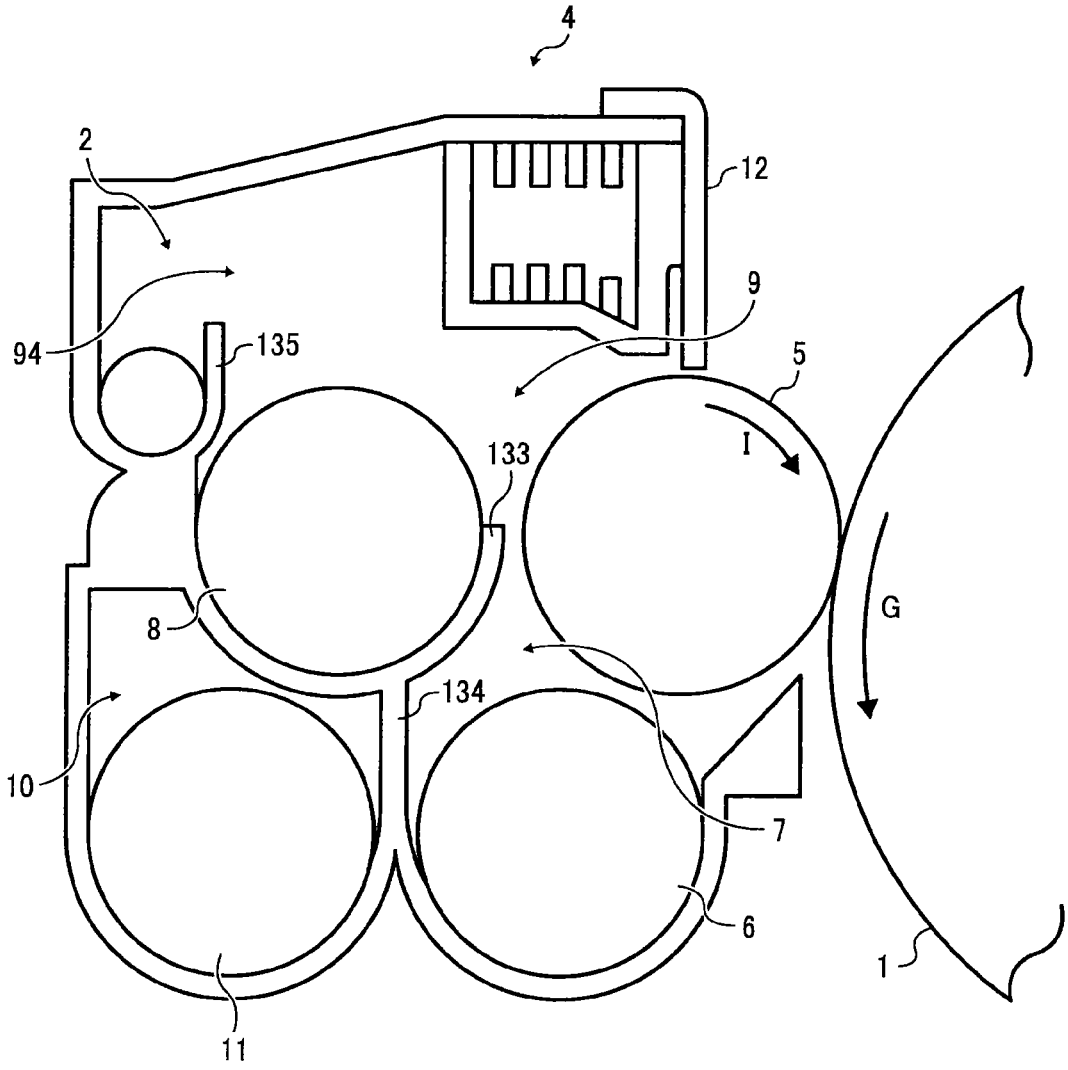
FIG. 2 shows a schematic configuration of a development device and a photosensitive body of the copier.

FIG. 2 shows the development device 4 and photosensitive body 1 that are provided in one of the four process cartridges 18Y, M, C, K. The four process cartridges 18Y, M, C, K have substantially identical configurations, except that the colors of toners employed therein are different. Therefore, the reference symbols Y, M, C, K attached to "4" are omitted in the figures.

As shown in FIG. 2, the surface of the photosensitive body 1 is charged by a charging device (not shown in the figure), while the photosensitive body is being rotated in the direction shown by arrow G in the figure. The charged surface of the photosensitive body 1 is irradiated with a laser beam by an exposure device (not shown in the figure), an electrostatic latent image is formed, and a toner is supplied to the latent image from the development device 4 to form a toner image.

The development device 4 has a development roller 5 that serves as a carrier body for a developer. The development roller supplies the toner to develop the latent image on the surface of the photosensitive body 1, while moving the surface in the direction shown by arrow I in the figure. In addition, the development device has a feed screw 8 serving as a feeding and conveying member that conveys the developer in the depth direction in FIG. 2, while feeding the developer to the development roller 5. The feed screw 8 has a rotary shaft and a blade portion provided on the rotary shaft and serves as a developer conveying screw that conveys the developer in the axial direction by rotation.

A development doctor blade 12 serving as a developer regulating member that regulates the developer fed to the development roller 5 to a thickness appropriate for the development is provided on the downstream side in the surface movement direction from the portion of the development roller 5 that faces the feed screw 8.

A recovery screw 6 serving as a recovering and conveying member that recovers the developer that passed the development unit and was used for development and conveys the recovered developer in the same direction in which the feed screw 8 feeds the developer is provided on the downstream side in the surface movement direction from the development portion that is the portion of the development roller 5 that faces the photosensitive body 1. A feeding and conveying path 9 comprising the feed screw 8 is arranged in the transverse direction of the development roller 5, and the recovering and conveying path 7 containing the recovering screw 6 is provided parallel to the feeding and conveying path below the development roller 5.

An agitating and conveying path 10 is provided in a row with the recovering and conveying path 7 below the feeding and conveying path 9 in the development device 4. The agitating and conveying path 10 is provided with an agitating screw 11 serving as an agitating and conveying member that conveys the developer, while agitating it, in the forward direction, as shown in the figure, which is the direction opposite that in which the developer is fed by the feeding screw 8.

The feeding and conveying path 9 and the agitating and conveying path 10 are partitioned by a first partition wall 133 serving as a partition member. Openings are provided at both ends in the front side and rear side, as shown in the figure, in the first partition wall 133 that partitions the feeding and conveying path 9 and the agitating and conveying path 10, and the feeding and conveying path 9 and the agitating and conveying path 10 communicate via these openings.

The feeding and conveying path 9 and the recovering and conveying path 7 are also partitioned by the first partition wall 133, but no openings are provided in the locations where the feeding and conveying path 9 and the recovering and conveying path 7 are partitioned by the first partition wall 133.

The agitating and conveying path 10 and the recovering and conveying path 7 are partitioned by a second partition wall 134 serving as a partition member. The second partition wall 134 is provided with an opening at the front side, as shown in the figure, where the agitating and conveying path 10 and the recovering and conveying path 7 communicate with each other.

In the development device 4, a developer accommodating unit that accommodates the developer is composed of the feeding and conveying path 9, recovering and conveying path 7, and agitating and conveying path 10.

The developer that has been used for the development is recovered in the recovering and conveying path 7 and conveyed to the front side of the cross section in FIG. 2. In the opening of the first partition wall 133 provided in an image-free region, the developer is transferred into the agitating and conveying path 10. In the vicinity of the opening of the first partition wall 133 on the upstream side in the conveying direction of the developer in the agitating and conveying path 10, a premix toner composed of the toner and carrier is supplied into the agitating and conveying path 10 from the toner replenishment port provided above the agitating and conveying path 10.

The circulation of the developer in the three developer conveying paths will be described below.

Figure 3:
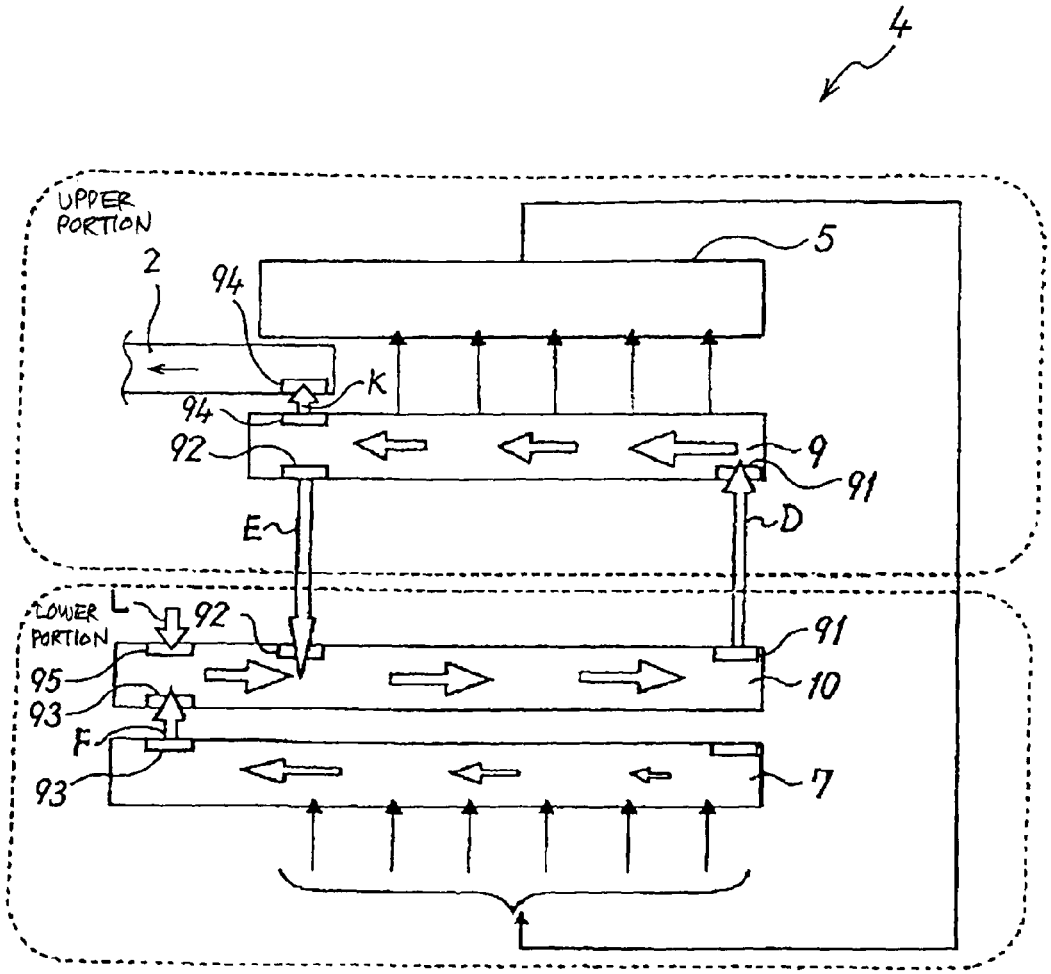
FIG. 3 is a schematic diagram illustrating the flow of the developer inside the development device.

FIG. 3 shows a flow of the developer in the developer conveying paths. The arrow in the figure shows the direction in which the developer moves.

In the feeding and conveying path 9 that received the developer feed from the agitating and conveying path 10, the developer is conveyed to the downstream side of the feed screw 8 in the conveying direction, while the developer is fed to the development roller 5. Further, the extra developer that is conveyed to the downstream side of the feeding and conveying path 9 in the conveying direction, without being fed to the development roller 5 or used for development, is fed from an extra opening 92 of the first partition wall 133 to the agitating and conveying path 10 (arrow E in FIG. 3).

The recovered developer that has been supplied from the development roller 5 to the recovering and conveying path 7 and conveyed by the recovery screw 6 to the downstream end of the recovering and conveying path 7 in the conveying direction is fed from a recovery opening 93 of the second partition wall 134 to the agitating and conveying path 10 (see arrow F in FIG. 3).

Further, in the agitating and conveying path 10, the supplied extra developer and the recovered developer are agitated, conveyed to the upstream side of the feed screw 8 in the conveying direction, which is the downstream side of the agitating screw 11 in the conveying direction, and fed from a feed opening 91 of the first partition wall 133 into the feeding and conveying path 9 (arrow D in FIG. 3).

In the agitating and conveying path 10, the recovered developer, extra developer, and premix toner that is replenished, if necessary, from the toner replenishment port 95, are agitated and conveyed by the agitating screw 11 in the direction opposite that of the developer in the recovering and conveying path 7 and feeding and conveying path 9. The agitated developer is then transferred to the upstream side of the feeding and conveying path 9 in the conveying direction, this path communicating with the recovering and conveying path on the downstream side in the conveying direction. A toner concentration sensor (not shown in the figure) is provided below the agitating and conveying path 10, the tone replenishment device that is described below in greater detail is actuated by the sensor output, and toner replenishment is performed from the toner accommodation unit. Further, when toner replenishment is performed in the development device 4, the premix toner in which the replenishment carrier is admixed to the replenishment toner is replenished.

In the development device 4 shown in FIG. 3, the feeding and conveying path 9 and the recovering and conveying path 7 are provided, and the developer is fed and recovered in different developer conveying paths. Therefore, the developer that has been used for the development is not admixed to the feeding and conveying path 9. Therefore, the concentration of toner in the developer fed to the development roller 5 on the downstream side of the feeding and conveying path 9 in the conveying direction can be prevented from decreasing. Further, because the recovering and conveying path 7 and the agitating and conveying path 10 are provided and the developer is recovered and agitated in the different developer conveying paths, the developer that has been used for the development does not fall down during agitation. Accordingly, because the developer subjected to sufficient agitation is fed into the feeding and conveying path 9, the developer fed to the feeding and conveying path 9 can be prevented from being agitated insufficiently. Therefore, the concentration of toner in the developer in the feeding and conveying path 9 can be prevented from decreasing and the developer in the feeding and conveying path 9 can be prevented from being agitated insufficiently. Therefore, a constant density of image during the development can be obtained.

Figure 4:
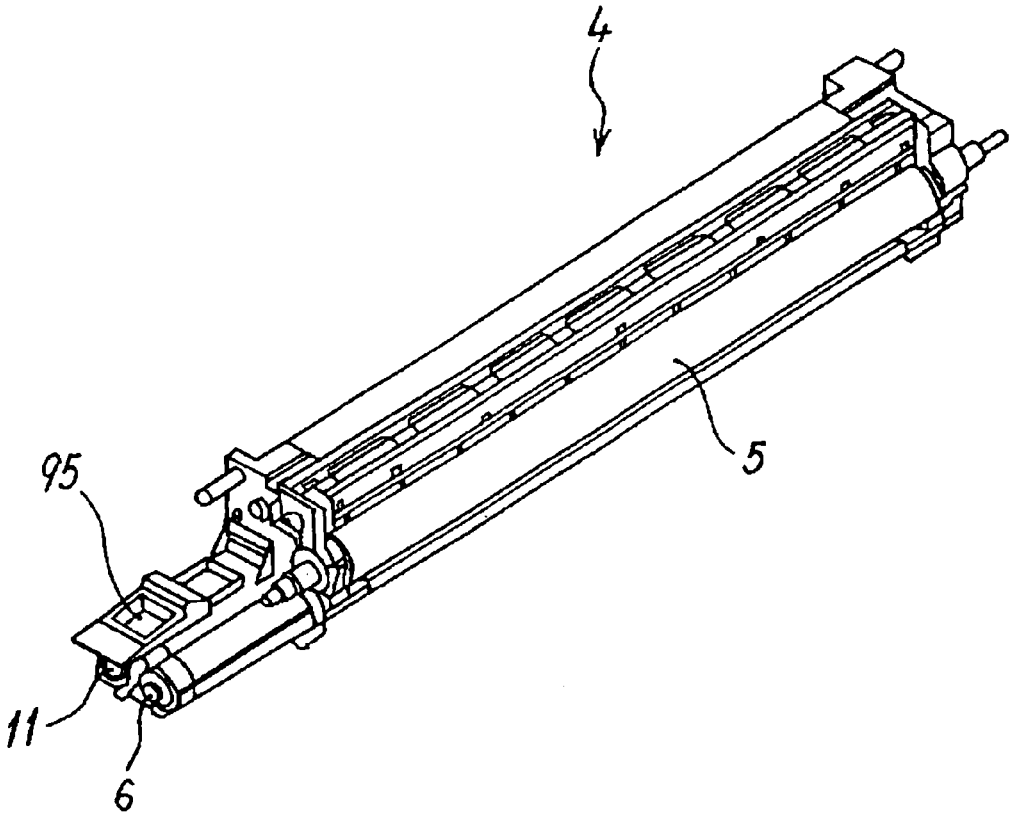
FIG. 4 is a perspective view illustrating the external appearance of the development device.

The position in which the premix toner is supplied into the developer conveying path of the development device 4 that is composed of the feeding and conveying path 9, agitating and conveying path 10, and recovering and conveying path 7 will be explained below. FIG. 4 shows the external appearance of the development device 4.

As shown in FIG. 4, the toner replenishment port 95 for replenishing the premix toner is provided above the upstream end portion, in the conveying direction, of the agitating and conveying path 10 equipped with the agitating screw 11. The toner replenishment port 95 is provided outside the end portion of the development roller 5 in the width direction.

Further, the toner replenishment port 95 may be provided not only above the upstream end portion of the agitating and conveying path 10 in the conveying direction, but also above the downstream end portion of the recovering and conveying path 7.

Moreover, the toner replenishment port 95 may be also provided directly above the recovery opening 93, which is the location where the developer is transferred from the recovering and conveying path 7 to the agitating and conveying path 10. Because the developer is easily mixed in the recovery opening 93, which is the transfer portion, by performing replenishment in this position, it is possible to agitate the developer with higher efficiency.

A toner replenishment device 500 serving as a developer replenishment device for replenishing the premix toner from the toner replenishment port 95 of the development device 4 inside the development device 4 will be described below.

Figure 5:
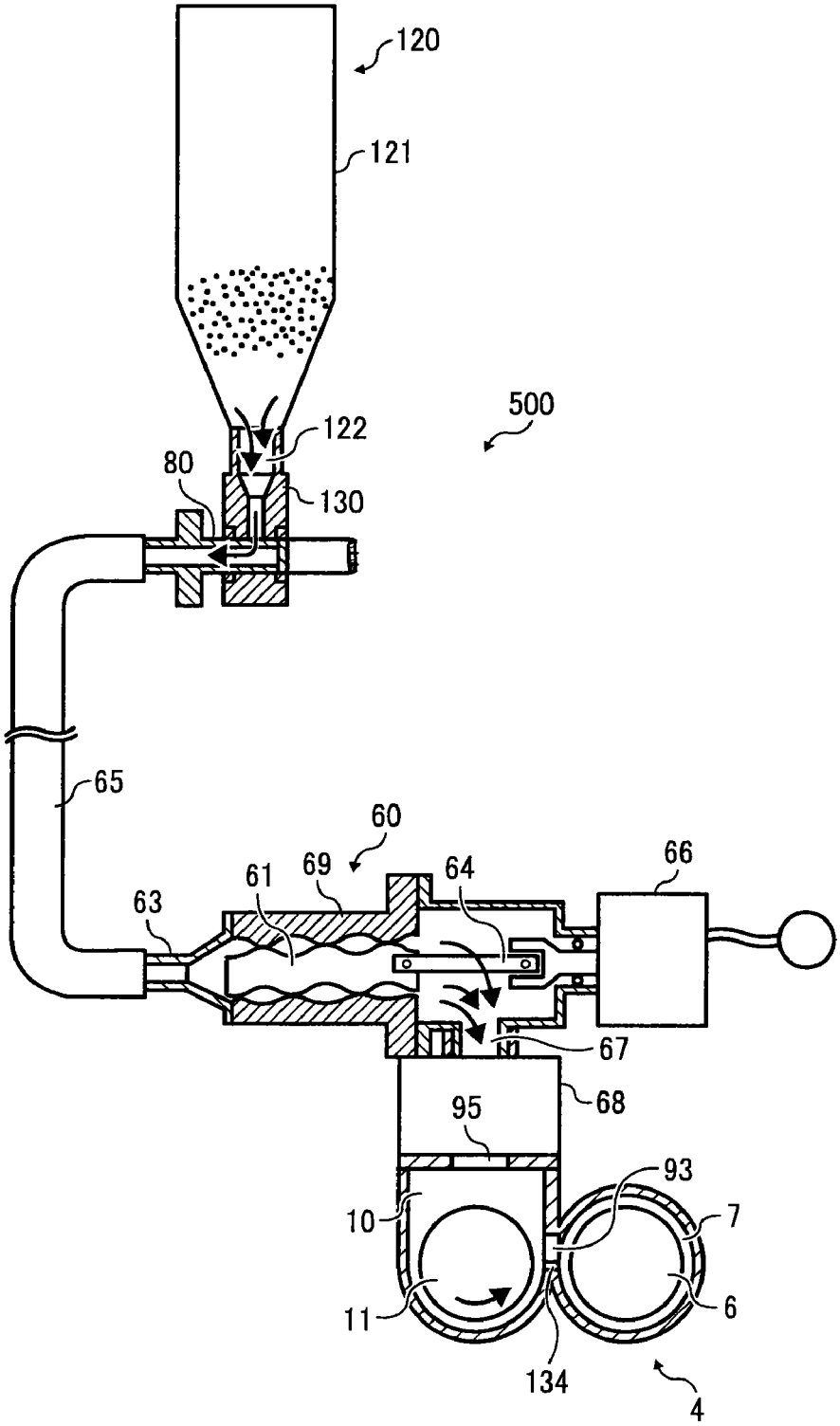
FIG. 5 shows the configuration of a toner replenishment device of the development device.
Figure 6:
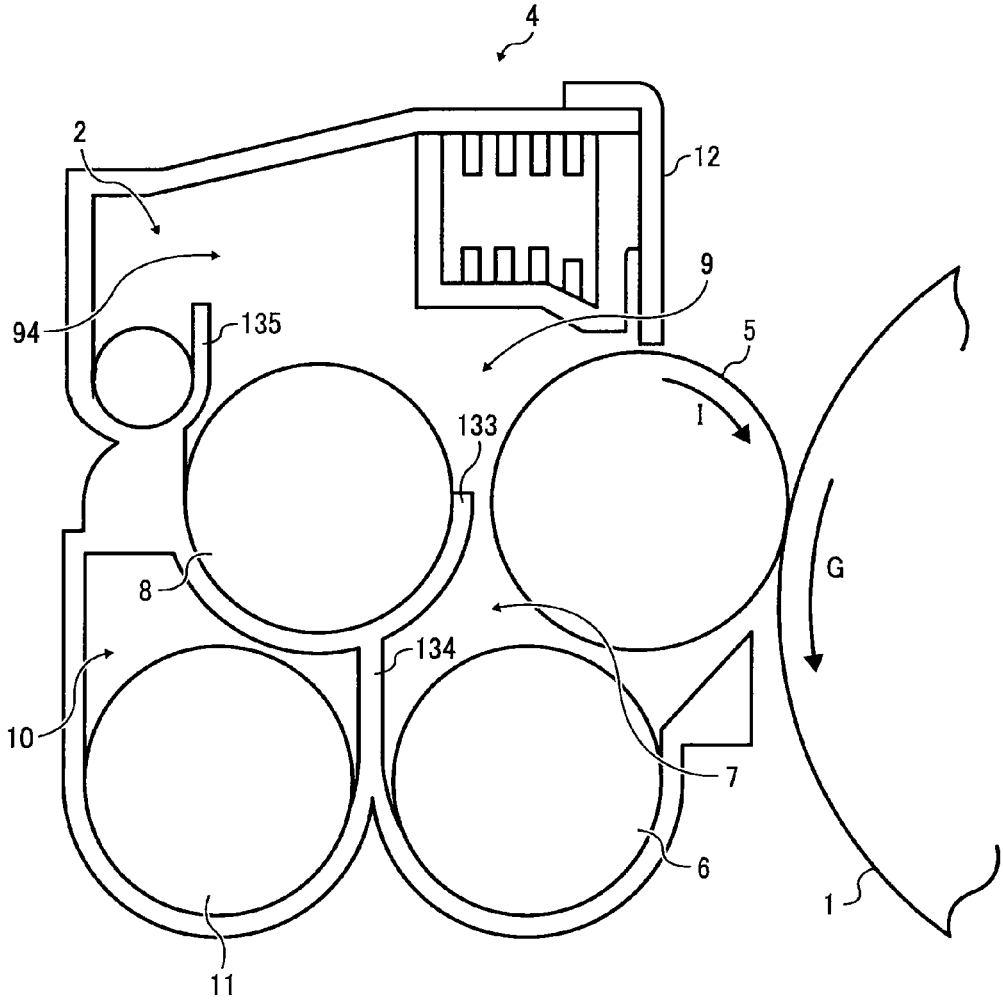
FIG. 6 is a cross-sectional view showing the configuration of the toner replenishment device of the development device.
Figure 7:
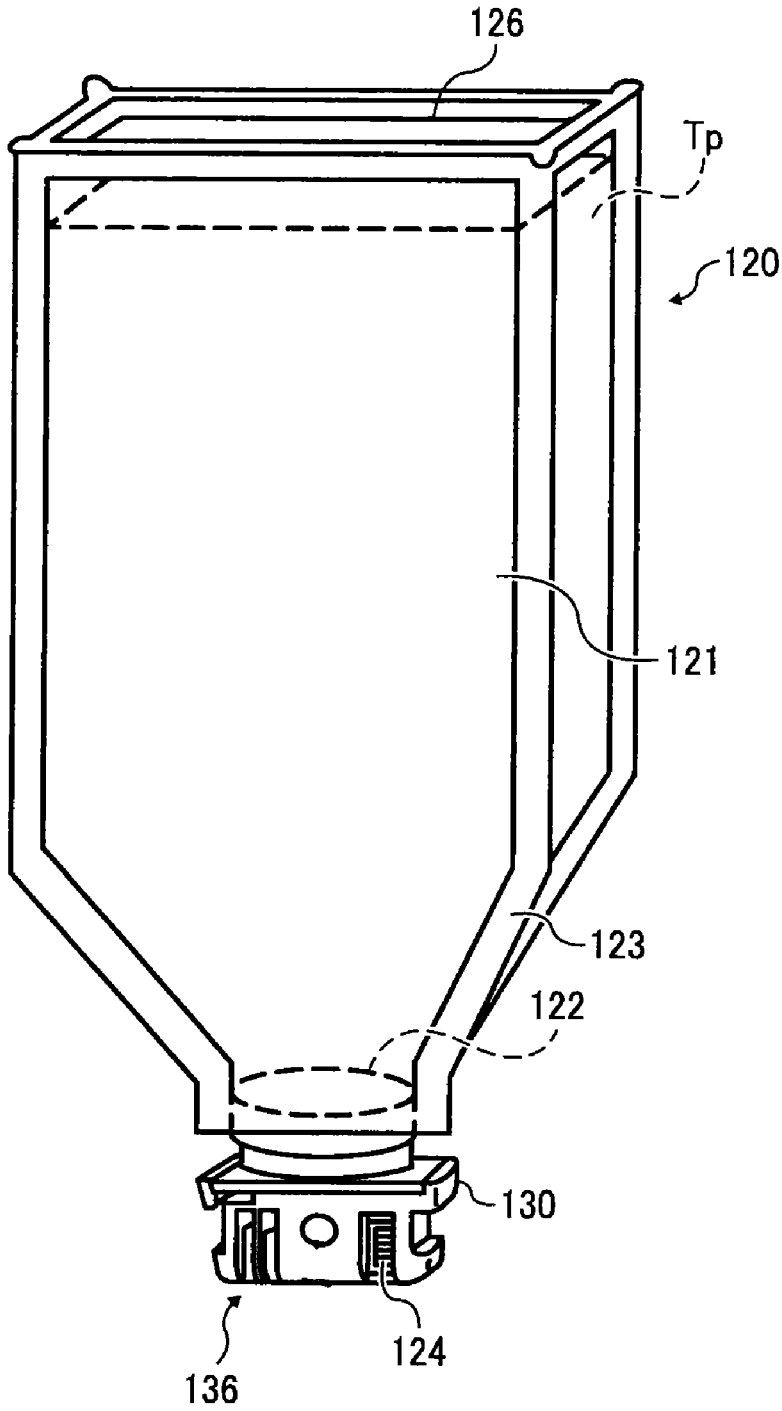
FIG. 7 is a perspective view illustrating the external appearance of a toner bottle.

FIGS. 5 and 6 illustrate the configuration of the toner replenishment device 500 provided in the copier. FIG. 7 illustrates the external appearance of a toner bottle 120, which is a developer accommodating container. The toner bottle 120 is a developer accommodating container that accommodates a premix toner Tp, which comprises a replenishment toner and a replenishment carrier and has a toner ratio higher than that in the developer inside the development device 4. The reference symbol Tf in FIG. 5 shows the flow of the premix toner Tp.

In an image forming apparatus of a tandem system, the copier has a configuration in which the toner bottles 120 accommodating the premix toners Tp of each color are arranged side by side, as shown in FIG. 5. The toner bottle 120 of each color is connected to a replenishment unit comprising a sub-hopper 68 and a toner pump 60, which is a powder pump, via a toner replenishment tube 65 serving as a conveying path member for each developer, and the development device 4 is connected below the replenishment unit. A screw pump comprising a stator 69, which is an elastic member having a spiral groove inside thereof, and a rotor 61, which moves the premix toner Tp in the axial direction by rotation inside the stator 69, is used as the toner pump 60. A toner pump 60 described in Japanese Patent Application Laid-open No. 2000-98721 can be used as the toner bottle 120.

As shown in FIGS. 6 and 7, the toner bottle 120 is composed of a toner accommodating body 121, which is a developer accommodating body, and a socket member 130 that is attached to a toner discharge port 122, which is a developer discharge port serving as an opening. A specific configuration of the toner bottle 120 will be described below in greater detail.

When the toner bottle 120 is set in the copier body, a state is assumed in which a distal end of a nozzle 80 serving as a joining member on the apparatus body side that is joined to the socket member 130 is inserted into the toner bottle 120. As a result, the toner discharge port 122 and the toner reception portion of the nozzle 80 are connected. The nozzle 80 has a joint-shaped portion for connecting the tubes, the toner replenishment tube 65 communicates with the toner pump 60, and the toner pump 60 communicates with the development device 4 via the sub-hopper 68. Once the toner bottle 120 is set in the copier body, the toner bottle communicates with the development device 4.

The toner pump 60 is called a suction-type single-shaft eccentric screw pump; and comprises the rotor 61 and the stator 69 as the two main components. The rotor 61 is formed by spirally twisting a hard, shaft-like member with a round cross section and is joined to a drive motor 66 via a universal joint 64. The stator 69 is produced from a rubber-like soft material and has an orifice of a shape obtained by spirally twisting an elliptical cross section. The spiral pitch of the stator 69 is formed to be twice as large as that of the rotor 61. By mating these two components and rotating the rotor 61, it is possible to transfer the premix toner Tp introduced into the space that appear between the rotor 61 and stator 69.

In the configuration shown in FIG. 6, the drive motor 66 and the universal joint 64 are directly connected. Explaining the transmission of drive force with reference to FIG. 5, the drive force from the drive motor 66 is transmitted to the universal joint 64 via the drive shaft 66*b* and drive shaft gear 66*a*.

With the toner pump 60 of such a configuration, where the rotor 61 is rotary driven, the premix toner Tp inside the toner bottle 120 enters from the toner suction portion 63 into the toner pump 60. Then, the premix toner is sucked in and conveyed from the left to the right, as shown in FIG. 6, and fed from the toner discharge port 67 via the sub-hopper 68, and then from the toner replenishment port 95 of the development device 4 disposed below the sub-hopper 68 into the development device 4.

FIG. 7 shows an external appearance of the toner bottle 120.

Referring to FIG. 7, the toner accommodating body 121 that accommodates the premix toner Tp in the toner bottle 120 is formed to have a bag-like shape by fusing a sheet-like resin called a soft packaging material. The sheet-like resin constituting the toner accommodating body 121 is used in the form of a single film obtained by laminating a plurality of resin films of different properties. More specifically, when the film is formed to obtain a bag-like shape, it is configured to have a three layer configuration composed of a fusion layer from an easily fusible material, an air-tight layer from a material with excellent air tightness, and a rigid layer that excels in rigidity, the layers being described from the inner side of the film.

Polyethylene or similar material that melts at a comparatively low temperature is used as the fusion layer, and PET, Nylon, aluminum, or paper is used for the air-tight layer or rigid layer according to the type of the contents (solid, liquid, powdered, and the like) or object (feed, drugs, etc.). The toner bottle 120 used in the copier consists of a composite material composed of three materials (polyethylene, Nylon, PET) arranged in the order of description from the inner side to the outer side of the toner accommodating body 121.

Each layer of the toner accommodating body 121 will be described below in greater detail.

Where a material that melts at a comparatively low temperature is used for the fusion layer that is located on the inner side when the toner accommodating body 121 is formed to have a bag-like shape, the entire fusion layer melts uniformly under heating and the sheet-like member can be attached without a gap.

Further, when the premix toner Tp comes into contact with the ambient air during storage, the premix toner Tp can deteriorate. In particular, the premix toner Tp aggregates in a humid environment, thereby causing ineffective toner replenishment. To avoid such adverse effects, the air tightness of the toner bottle 120 is increased by providing an air-tight layer on the sheet-like member constituting the bag-like member.

Because the toner bottle 120 is directly touched by the user, handleability of the toner bottle has to be taken into account. Where a material with a comparatively high rigidity is used for the sheet-like member constituting the bag-like member, the rigidity of the toner bottle 120 can be adjusted by changing the thickness of the material. Therefore, a desired rigidity can be imparted to the toner bottle 120.

Further, a layer other than the above-described three layers may be also provided.

The toner accommodating body 121 is obtained through formation of the bag by repeating a step of folding the sheet-like member so that the fusion layers face each other and fusing. There are also non-fused toner accommodation bodies 121 in which the sheet-like members are joined by using an adhesive (for example, paper bags). In such case, a ridge line is formed by bending the container. Therefore, the strength of the ridge line is equal to that of other portions. Accordingly, in the toner accommodating body 121, a fusion margin 123 is left for the ridge line, the two sheets are fused in the fusion margin 123 and the thickness of the sheet becomes twice as large as that of the other portions. As a result, the ridge line of the container acts as a "pillar", thereby increasing the rigidity of the entire container. The container is thus prevented from buckling under the effect of vibrations during transportation or collisions occurring when the container is dropped. Furthermore, the toner bottle 120 is prevented from being closed by the deformation of the surface portion in the vicinity of the toner discharge port 122 during the replenishment of the premix toner Tp.

Because the toner accommodating body 121 is thus formed from a sheet, it can be deformed according to the shape or amount of the contents, and the volume thereof can be reduced with the decrease in the amount of the contents. For example, the used toner bottle 120 can be rolled into a small object and recovered. Therefore, the primary storage space of the used container can be decreased by comparison with that of the non-deformable developer accommodating container. Furthermore, the transportation cost during the recovery can be reduced.

Further, the toner bottle 120 is not equipped with a deformable agitating member such as a screw or a coil inside the toner accommodating body 121. Even with such toner bottle 120, the premix toner Tp inside the toner accommodating body 121 can be effectively discharged when the premix toner Tp is sucked in by the toner pump 60, which is a powder pump, as in the toner replenishment device 500. The toner pump 60 is a suction-type single-shaft eccentric screw pump called "a mono pump".

Where the toner pump 60 is driven and a negative pressure acts upon the toner discharge port 122, the premix toner Tp is discharged from the toner discharge port 122 to the outside of the toner bottle 120. In this case, the toner accommodating body 121 is shrunk under the effect of the negative pressure created by the suction force of the toner pump 60, and the volume of the toner bottle 120 is reduced.

Because the deformable toner accommodating body 121 is difficult to fix to the toner replenishment device 500, the toner accommodating body 121 is attached to the socket member 130 composed of a hard resin or the like, and where the socket member 130 and the toner replenishment device 500 are formed so that they can be joined together, the toner bottle 120 can be reliably set in the toner replenishment device 500.

The socket member 130 is composed of a rigid molded resin and is smaller in size than the toner accommodating body 121. Where the inner layer of the toner accommodating body 121 and the socket member 130 are formed from polyethylene, they can be attached without a gap by fusion. More specifically, the socket member 130 and the toner accommodating body 121 can be fused together by inserting part of the socket member 130 into the toner accommodating body 121 and applying a load with a heated fusion tool.

In the toner bottles 120 composed of such soft toner accommodating body 121 and the socket member 130, the shape of the attachment member 136, which is a portion of the socket member 130 designed for engagement with the main body, differs between the toner bottles 120 of different colors. As a result, a toner bottle 120 of a wrong color is prevented from being set. In addition, an RF tag 124, which is an information recording member, is provided on the side surface of the socket member 130. Here, the RF tag 124 is an information medium where the data of the incorporated memory can be written in a contactless matter by using electromagnetic waves. For example, the information relating to the types of the toner bottle 120 and the image forming apparatus conforming to the premix toner Tp accommodated inside the container, the toner color, the manufacturing date, and the remaining amount of toner is recorded in the RF tag 124.

The replacement of developer in the development device 4 will be described below.

As described hereinabove, in the toner replenishment device 500, which is a developer replenishment device, the premix toner Tp serving as a replenishment developer inside the toner bottle 120, which is a developer accommodating container, is replenished from the toner replenishment port 95 into the development device 4.

The development device 4 has a developer discharge port 94, which is a developer discharge means for discharging part of the developer to the outside of the development device when the volume of the developer inside the feeding and conveying path 9 exceeds a predetermined level, and a discharging and conveying path 2 serving to convey the developer discharged from the developer discharge port 94 to the outside of the development device 4. The discharging and conveying path 2 is disposed adjacently to the feeding and conveying path 9 so as to be separated therefrom by the partition wall 135 on the downstream side of the feeding and conveying path 9 in the conveying direction, and the developer discharge port 94 is an opening provided in the partition wall 135 so as to connect the feeding and conveying path 9 and the discharging and conveying path 2.

In the development device 4, the developer accumulates in the vicinity of the downstream end of the feeding and conveying path 9 in the conveying direction according to the balance of the conveyed amount of the developer in the feeding and conveying path 9, the amount of the developer fed to the development roller 5, and the amount of the developer transferred from the feeding and conveying path 9 passing through the excess opening 92 into the agitating and conveying path 10. As long as the amount of the developer inside the development device 4 is constant, the amount of the developer reaching the vicinity of the downstream end of the feeding and conveying path 9 in the conveying direction per unit time is equal to the amount of the developer that is transferred through the excess opening 92 into the agitating and conveying path 10 per unit time, and the volume of the accumulated developer becomes constant. On the other hand, where the amount of the developer inside the development device 4 increases, the amount of the developer reaching the vicinity of the downstream end of the feeding and conveying path 9 in the conveying direction per unit time becomes larger than the amount of the developer that is transferred through the excess opening 92 into the agitating and conveying path 10 per unit time. As a result, the volume of the developer accumulated in the vicinity of the downstream end of the feeding and conveying path 9 in the conveying direction increases.

Further, the developer discharge port 94 is disposed in a position in which the developer accumulates in the vicinity of the downstream end of the feeding and conveying path 9 in the conveying direction, and when the volume of the accumulated developer increases, the developer that reached the height of the developer discharge port 94 is discharged into the discharging and conveying path 2.

In such development device 4, when the premix toner Tp is not fed from the toner replenishment device 500, and the amount of the developer inside the development 4 practically does not change, the volume of the developer accumulated in the vicinity of the downstream end of the feeding and conveying path 9 in the conveying direction is also almost constant. On the other hand, where the premix toner Tp is replenished into the development device 4 by the toner replenishment device 500, the amount of the developer inside the development device 4 increases and the volume of the developer that accumulates in the vicinity of the downstream end of the feeding and conveying path 9 in the conveying direction also increases. Further, where the volume of the developer in the vicinity of the downstream end of the feeding and conveying path 9 in the conveying direction rises to the height of the developer discharge port 94, the developer that reached the height of the developer discharge port 94 is discharged to the discharging and conveying path 2 and then discharged via the discharging and conveying path 2 to the outside of the development device 4.

The developer discharged to the outside of the development device 4 from the developer discharge port 94 via the discharging and conveying path 2 contains the toner and carrier, and the premix toner Tp contains the unused toner and carrier. Therefore, by replenishing the premix toner Tp of the toner replenishment device 500 and discharging the developer from the developer discharge port 94, it is possible to replace the toner inside the development device 4.

In some conventional image forming apparatuses equipped with a two-component development devices using a developer composed of a toner and a carrier, only the toner is supplied to the development device by the toner replenishment device to replenish the toner used for the development. In such image forming apparatuses, the developer inside the development device deteriorates as it is used, causing image deterioration and scattering of toner. As a result, where the developer is replenished with the toner alone, a serviceman periodically performs a maintenance operation of replacing the developer.

On the other hand, by replenishing the premix toner Tp composed of the toner and carrier in the development device 4, as in the copier of the present embodiment, it is possible to replace the developer located in the development device 4 during the image forming operation and reduce the ratio of deteriorated carrier in the entire carrier present in the development device. As a result, the maintenance interval can be increased and the downtime can be reduced.

A loading device for loading the replenishment developer composed of a replenishment toner and a replenishment carrier into the toner bottle 120, which is the developer accommodating container of the present embodiment, will be described below.

Figure 8:
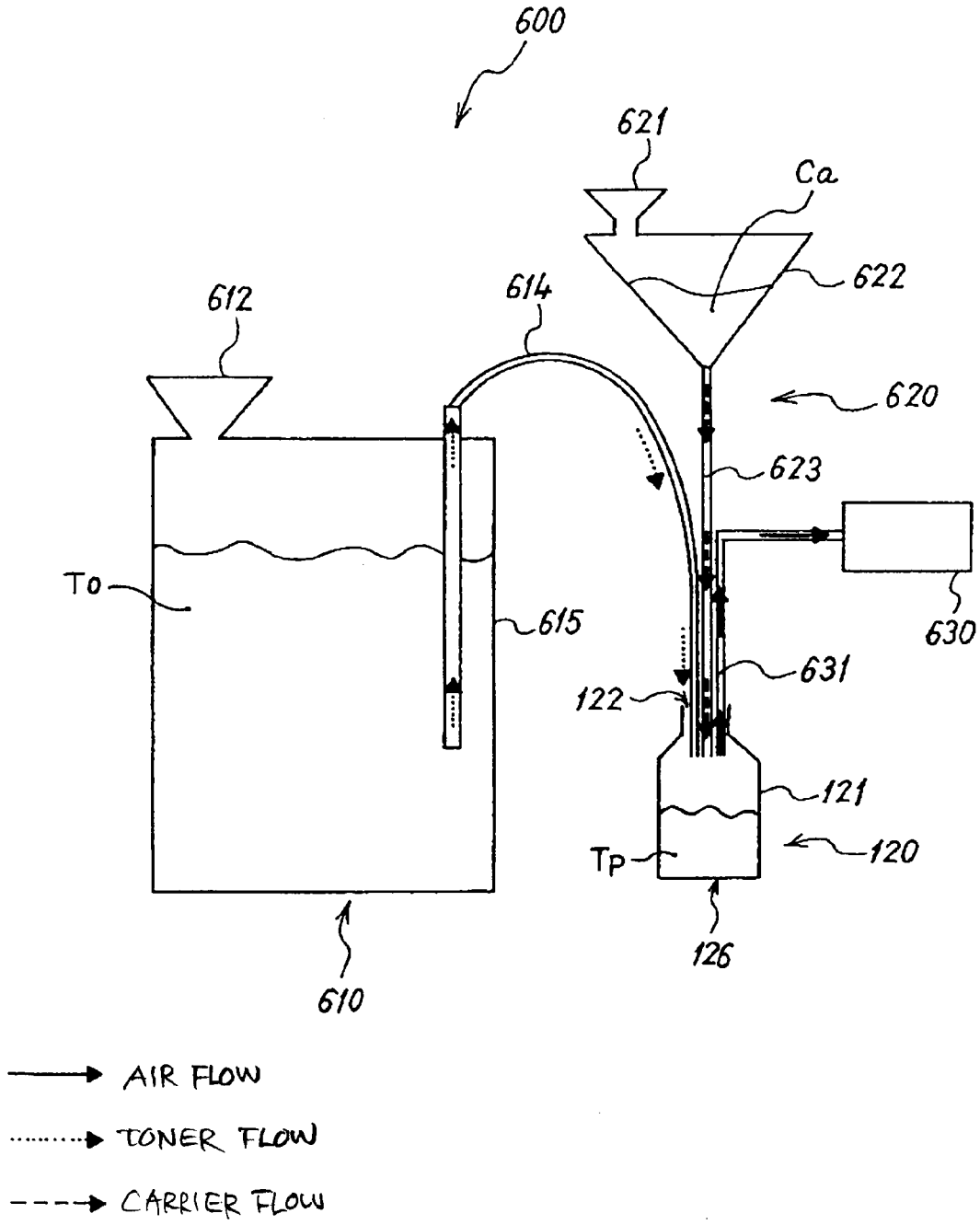
FIG. 8 illustrates the configuration of a developer loading device.

FIG. 8 shows a developer loading device 600 that loads the premix toner Tp, which is the replenishment developer, into the toner bottle 120 of the present embodiment.

As shown in FIG. 8, the developer loading device 600 has a toner loading device 610 that loads the replenishment toner To into the toner bottle 120 and a carrier loading device 620 that loads the replenishment carrier Ca into the toner bottle 120. In addition, there is provided a deaeration device 630 that removes the air from the toner bottle 120 after the replenishment toner To and replenishment carrier Ca have been loaded. Further, when the replenishment toner To and replenishment carrier Ca are loaded into the toner bottle 120, the toner bottle 120 is placed so that the toner discharge port 122 faces upward, and the replenishment toner To and replenishment carrier Ca are loaded from the toner discharge port 122 as shown in FIG. 8.

The toner loading device 610 has a toner storage unit 615 that stores the toner To fed from the toner feeding port 612. A toner loading nozzle 614 that conveys the replenishment toner To inside the toner storage unit 615 by the suction force of a powder pump (not shown in the figure) is connected to the toner storage unit 615. By inserting the end portion of the toner loading nozzle 614 on the side that is not connected to the toner storage unit 615 into the toner discharge port 122, which is a developer discharge port of the toner bottle 120 serving as a developer accommodating container and driving the powder pump (not shown in the figure) it is possible to load the replenishment toner To into the toner bottle 120. The loaded amount of the replenishment toner To is regulated by the driving time of the powder pump (not shown in the figure).

On the other hand, the carrier loading device 620 has a carrier storage unit 622 that stores the replenishment carrier Ca fed from the carrier feed port 621. A carrier loading nozzle 623 is connected to the lowermost portion of the carrier storage unit 622, and a switching valve (not shown in the figure) is provided in the connection portion of the carrier storage unit 622 and the carrier loading nozzle 623. By inserting the end portion of the carrier loading nozzle 623 on the side that is not connected to the carrier storage unit 622 into the toner discharge port 122 of the toner bottle 120 and opening the switching valve (not shown in the figure), it is possible to load the replenishment carrier Ca into the toner bottle 120. The replenishment carrier Ca moves from the carrier storage unit 622 into the toner bottle 120 under gravity, and the amount of loaded replenishment carrier Ca is regulated by the opening time of the switching valve (not shown in the figure).

Further, one end of a deaeration nozzle 631 is connected to a deaeration device 630. By inserting the other end into the toner discharge port 122 of the toner bottle 120 and driving the deaeration device 630, it is possible to remove the air present inside the toner bottle 120.

Where the replenishment toner To and replenishment carrier Ca are loaded into the toner bottle 120 in the above-described manner, a state is assumed in which the premix toner Tp composed of the replenishment toner To and replenishment carrier Ca is loaded into the toner bottle 120. As a result, the toner bottle 120 becomes a loaded developer accommodating container.

In the toner replenishment device 500 of the present embodiment, the toner bottle 120 serving as a loaded developer accommodating container is mounted and the toner pump 60 is driven to suck in the premix toner Tp inside the toner accommodation boy 121 by the negative pressure. The premix toner Tp that has been sucked in by the negative pressure of the toner pump 60 is discharged from the toner discharge port 122, conveyed inside the toner replenishment tube 65, and fed into the development device 4. The tests performed by the inventors in which the premix toner Tp was conveyed by using the toner pump 60 demonstrated that the conveying operation using the toner pump 60 is sometimes impossible. When the toner alone was conveyed or when a mixture of the toner and carrier was conveyed, the conveying operation using the toner pump 60 could be performed without any problem, but when the carrier alone was conveyed, the space between the rotor 61 and stator 69 of the toner pump 60 was clogged and the carrier could not be moved even when the negative pressure was applied, thereby making it impossible to convey the carrier with the toner pump 60.

For this reason, the carrier has to be discharged from the toner bottle 120 in a state in which the carrier is covered, however sparsely, with the toner. The toner that adhered to the carrier acts as "rollers", thereby preventing the space between the rotor 61 and stator 69 of the toner pump 60 from being clogged with the carrier.

On the other hand, when the carrier alone is discharged from the toner bottle 120, the space between the rotor 61 and stator 69 of the toner pump 60 is clogged with the carrier, and the conveying operation performed by the toner pump 60 becomes impossible, a repair operation such as the replacement of parts and maintenance performed by a serviceman are necessary. In this case, the image forming apparatus cannot be used until the repair operation is completed, thereby creating a downtime.

As described hereinabove, because the toner bottle 120 is not provided with an agitating member inside the toner accommodating body 121, the premix toner Tp accommodated inside the toner accommodating body 121 of the loaded toner bottle 120 cannot be agitated. Therefore, for certain modes of loading the replenishment toner To and replenishment carrier Ca with the developer loading device 600, it is possible that only the replenishment carrier Ca be discharged from the toner discharge port 122 at the initial stage of replenishment of the premix toner Tp after the loaded toner bottle 120 has been set in the toner replenishment device 500. Such an event in which only the replenishment carrier Ca is discharged at the initial stage of replenishment occurs because the vicinity of the toner discharge port 122 inside the toner accommodating body 121 of the loaded toner bottle 120 is a region where only the replenishment carrier Ca is present.

As described above, where only the replenishment carrier Ca is discharged from the toner discharge port 122, the conveying with the toner pump 60 becomes impossible.

The phenomenon according to which the vicinity of the toner discharge port 122 inside the toner accommodating body 121 becomes a region where only the replenishment carrier Ca is present occurs when the premix toner Tp is loaded into the toner bottle 120. In the developer loading device 600, the predetermined amount of the replenishment toner To and the predetermined amount of the replenishment carrier are loaded into the toner bottle 120 from the toner loading device 610 and carrier loading device 620, respectively. Because the predetermined amount of the replenishment toner To and the predetermined amount of the replenishment carrier Ca are thus loaded into the toner bottle 120, it is possible to obtain the predetermined ratio of the toner and carrier container in the premix toner Tp in the loaded toner bottle 120. However, because the replenishment toner To and replenishment carrier Ca are loaded independently, with such a loading method, the vicinity of the toner discharge port 122 inside the loaded toner bottle 120 can become a region in which the carrier alone is present.

When the premix toner Tp is thus loaded into the toner bottle 120, even if the vicinity of the toner discharge port 122 is a region in which only the replenishment carrier is present, by shaking the toner bottle 120 before setting it into the toner replenishment device 500, it is possible to eliminate the region in which only the carrier is present. When the toner bottle 120 is shaken, the toner and carrier are agitated and mixed, and the carrier is dispersed, albeit unevenly, inside the loaded toner bottle 120. Further, there is no carrier that is not covered with the toner. Due to the difference in specific gravity between the toner and carrier, the air is introduced between the particles of the toner and carrier by the shaking action during mixing, and while this air passes through, the carrier particles with a high specific gravity can easily move below the toner particles with a low specific gravity. In such cases, after the toner bottle 120 is shaken, the carrier is concentrated in the lower side of the toner bottle 120 that is allowed to stay in a stationary state and the toner is concentrated in the upper side of the toner bottle 120 that is allowed to stay in a stationary state. Even in such a state in which the toner and carrier are thus unevenly distributed inside the toner bottle 120, when the toner bottle 120 is shaken, the carrier particles and toner particles are brought into contact and the carrier particles are surrounded and covered with the toner particles even in the regions where the carrier particles are concentrated. Therefore, the toner is made present even in the zone where the carrier is concentrated, and the region where only the carrier is present can be eliminated. By eliminating the region where only the carrier is present, it is possible to prevent the occurrence of a state in which the carrier alone is sucked in, thereby making the conveyance impossible, when the premix toner Tp located in the toner bottle 120 is sucked in by the toner pump 60.

Therefore, when the user replaces the toner bottle 120, it is possible to ensure that the toner pump 60 will convey the premix toner by shaking the toner bottle 120 before setting it into the toner replenishment device 500.

However, it is possible that the user will forget to shake the toner bottle 120 before installing it into the toner replenishment device 500. Furthermore, in the developer accommodating container in which no agitating member is present inside the toner accommodating body 121, as in the toner bottle 120, the premix toner Tp inside the toner accommodating body 121 does not move after the container is set into the toner replenishment device 500 and before the replenishment is started. As a result, when the loaded toner bottle 120 in which the vicinity of the toner discharged port 122 in the toner accommodating body 121 became a region where only the carrier is present is installed in the toner replenishment device 500, without shaking the toner bottle, it is possible that the carrier alone will be discharged when the replenishment is started, thereby making the conveyance with the toner pump 60 impossible.

In order to resolve this problem, a loading method can be considered by which the replenishment toner To and replenishment carrier Ca are premixed at a predetermined ratio to obtain a premix toner Tp in which the carrier is dispersed in the toner and such premixed toner is loaded into the toner bottle 120. In the process of manufacturing the loaded toner bottle 120, no problem arises if the replenishment toner To and replenishment carrier Ca are mixed in capacity units of one toner bottle 120. However, with consideration for production efficiency, the mixing is generally performed in large quantities for a plurality of toner bottles 120. In such cases, the carrier is unevenly distributed inside the premix toner Tp due to the difference in gravity between the toner and carrier, and there is a spread in the amount of carrier contained in the premix toner Tp loaded into each toner bottle 120. In some cases, the premix toner can contain no carrier at all. When such a toner bottle 120 is used, the carrier is not supplied into the development device 4. As a result, the increase in the ratio of the deteriorated developer inside the development unit 4 cannot be inhibited.

Therefore a loading method is desired by which the replenishment toner To and replenishment carrier Ca are loaded into the toner bottle 120 so that no ineffective conveying with the toner pump 60 occurs when the replenishment is started even in the case where the loaded toner bottle 120 is set without shaking into the toner replenishment device 500.

Accordingly, in the present embodiment, the replenishment toner To and replenishment carrier Ca are loaded into the toner bottle 120 in a state such that the premix toner Tp present in the vicinity of the toner discharge port 122 of the loaded toner bottle 120 does not contain only the carrier.

Here, the premix toner Tp located in the loaded toner bottle 120 will be described below in greater detail with reference to FIG. 7.

In the present embodiment, in the loaded toner bottle 120, the premix toner Tp is loaded so that the concentration of carrier in the premix toner Tp located in the vicinity of the container bottom portion 126 in the position farthest from the toner discharge port 122 is higher than the carrier concentration of the premix toner Tp in the vicinity of the toner discharge port 122.

The following states (1) to (3) can be presented as examples of states of the loaded toner bottle 120.

(1) Only the toner is present in the vicinity of the toner discharge port 122, and practically the entire carrier is concentrated in the vicinity of the container bottom 126.

(2) The concentration of carrier in the premix toner Tp increases gradually from the toner discharge port 122 to the container bottom 126.

(3) The concentration of carrier in the premix toner Tp inside the toner accommodating body 121 is almost uniform, but the concentration of carrier in the vicinity of the toner discharge port 122 is lower than in the other portion. Alternatively, only the toner is present in the vicinity of the toner discharge port 122.

The loaded toner bottles 120 of the above-described states (1) to (3) can be realized by the following developer loading methods (1) to (3), respectively.

(1) The predetermined amount of the replenishment carrier Ca is loaded and then the predetermined amount of the replenishment toner To is loaded.

(2) The loading of the replenishment toner To is started after the loading of the replenishment carrier Ca has been started and before the loading of the replenishment carrier Ca is finished, and the loading of the replenishment toner To is finished after the loading of the replenishment carrier Ca has ended. At this time, the amount of the replenishment carrier Ca loaded per unit time from the start to the end of the loading operation of the replenishment carrier Ca is decreased gradually.

(3) The loading of the replenishment carrier Ca and replenishment toner To is started simultaneously. In this case, the settings are such that the amounts of replenishment toner To and replenishment carrier Ca loaded per unit time are constant and the time required for the loaded amount to reach the predetermined amount is longer for the replenishment toner To.

Further, with the loading method (2) or (3), when the replenishment carrier Ca and replenishment toner To cannot be loaded at the same timing, the replenishment carrier Ca and replenishment toner To are loaded alternately and the settings are made such that the replenishment toner To is the last to be loaded in the alternate loading procedure.

When the replenishment carrier Ca and replenishment toner To are alternately loaded by the loading method (2), the replenishment carrier Ca and replenishment toner To are loaded alternately, with the replenishment carrier Ca being loaded first. In this case, the amount of the replenishment carrier Ca loaded in one cycle of such alternate loading is the largest in the initial loading cycle and this loaded amount decreases gradually with the transition to the second cycle, third cycle, . . . . On the other hand, the amount of the replenishment toner To loaded in one cycle during such alternate loading is constant, and the replenishment toner To is loaded in the very last cycle of such alternate loading. Further, the amount of the replenishment toner To loaded in one cycle of such alternate loading may be the smallest in the initial loading cycle and this loaded amount may increase gradually with the transition to the second cycle, third cycle, . . . .

When the replenishment carrier Ca and replenishment toner To are loaded alternately in the loading method (3), the amount of the replenishment carrier Ca and replenishment toner To loaded in one cycle is constant, and the replenishment toner To is loaded in the very last cycle of such alternate loading. Either the replenishment carrier Ca or the replenishment toner To may be loaded in the very first cycle of such alternate loading. However, where the replenishment carrier Ca is loaded in the first cycle, the replenishment toner To loaded in the next cycle easily forms a layer on top of the layer of the replenishment carrier Ca that has been heretofore loaded, and the replenishment toner hardly mixes with the replenishment carrier. Accordingly, it is more preferred that the replenishment toner To be initially loaded, because the subsequently loaded replenishment carrier Ca will easily mix therewith.

With such a developer, the carrier alone is not conveyed at the initial stage of discharge. Further, even if the carrier that is not covered with the toner is present, such carrier gradually comes into contact with the toner due to internal movement accompanying the discharge process and becomes covered with the toner before being discharged. Therefore, the carrier does not clog the mono pump and is conveyed to the development device.

Further, the toner bottle 120 of the present embodiment is disposed in the toner replenishment device 500 so that the toner discharge port 122 is in the lowermost portion of the toner bottle 120. In this case, a movement easily occurs in the premix toner Tp inside the toner bottle 120 as the premix toner Tp is discharged. Due to such movement of the premix toner Tp inside the toner bottle 120, the carrier that has a specific gravity larger than that of the toner easily moves to the toner discharge port 122 that is located below it. As a result, when the toner bottle 120 is installed in the toner replenishment device 500, the carrier that is concentrated in the vicinity of the container bottom 126 located above is discharged together with the toner, and the carrier is prevented from remaining inside the toner bottle 120.

Therefore, each time one batch of the premix toner Tp in the toner bottle 120 is replenished, the spent carrier is replenished in almost constant amount, thereby making it possible to inhibit the increase in the ratio of deteriorated developer inside the development device 4.

On the other hand, it is preferred that there be no large spread in the amount of carrier discharged in each replenishment even within one toner bottle 120.

A spread in the amount of carrier in the premix toner Tp discharged from the toner bottle 120 means that there is also a spread in the amount carrier supplied into the development device 4. When the carrier replenishment amount is small, the carrier located in the development device 4 is easily deteriorated, and when the carrier replenishment amount is large, a large amount of carrier that has not deteriorated is easily discharged. For this reason, even when the carrier replenishment amount in one toner bottle 120 is almost the same, if the spread in the carrier replenishment amount is large, the deterioration of carrier proceeds easier that in the case of small replenishment amount.

In the present embodiment, the carrier located in the toner bottle 120 is gradually dispersed following the discharge of the premix toner Tp. Therefore, the spread in the amount of carrier supplied to the development device in each replenishment cycle is also easily reduced.

It is preferred that the toner and carrier inside the toner accommodating body 121 be electrically charged and electrostatically attached to each other in the toner bottle 120 of the present embodiment. Where such a state is attained, it would be difficult for the toner to separate itself from the carrier surface, the toner surrounding the carrier will be easily attached thereto by electric charges, and the aggregation of carrier particles can be prevented.

The toner and carrier are slightly charged during loading, but friction-induced charging thereof also occurs when the toner bottle 120 is shaken before the toner bottle 120 is used.

The toner bottle 120 of the present embodiment contains the premix toner Tp serving as a replenishment developer and containing the toner and the carrier. It is preferred that a mixture of a toner and a premix carrier that is a developer obtained by mixing the carrier and part of the toner be loaded as the premix toner Tp. The premix carrier is a developer that has a carrier concentration higher than that of the premix toner Tp serving as a replenishment developer, in other words, a toner ratio lower than that of the premix toner Tp. Where the carrier is mixed in advance with part of the toner, they are electrically charged, and the carrier that is not covered with the toner is hardly present before the toner bottle 120 is used. Therefore, the discharge of the carrier alone from the toner discharge port 122 of the toner bottle 120 can be prevented. The premix carrier is produced by mixing the carrier and part of the toner with a mixer.

In order to realize the advantages of using the premix carrier, it is preferred that the toner coverage ratio of the carrier be 10% or more. Where the coverage ratio is less than 10%, the amount of toner attached to the carrier surface is small, and the aggregated carrier particles can be present inside the toner bottle 120. Conversely, where the coverage ratio is too high, the amount of toner that is not attached to the carrier is large and the carrier is unevenly distributed in the mixer. In such cases, a spread easily occurs in the amount of carrier in each toner bottle 120, in the same manner as in the case where the premix toner Tp with uneven carrier concentration is loaded. Therefore, it is preferred that the coverage ratio be not more than 200%. A range of 25 to 100% is even more preferred.

The coverage ratio of the carrier with the toner in the present embodiment is found by calculations, rather than by measurements. The coverage ratio is found by the following Eq. (1).

$$\text{Coverage Ratio} = \left(\frac{C}{100-C}\right)\times\left(\frac{R}{r}\right)^3\times\left(\frac{\rho c}{\rho t}\right)\times\left(\frac{\sqrt{3}}{2\pi}\right)\times\left(\frac{r}{R+r}\right)^2\times 100 \quad (1)$$

$C$: concentration of toner in premix toner (wt. %);

$R$: carrier radius (μm);

$r$: toner radius (μm);

$\rho c$: true specific gravity of carrier;

$\rho t$: true specific gravity of toner.

The toner bottle 120 of the present embodiment is loaded with the premix toner Tp by a developer loading method by which the replenishment carrier Ca is loaded and then the replenishment toner To is loaded. Where the loading is performed by such developer loading method, a state is easily assumed in which the concentration of carrier in the premix toner Tp in the container bottom 126 is higher than the concentration of carrier in the premix toner Tp in the vicinity of the toner discharge port 122. Further, for the toner to be present in a state of attachment to the carrier, it is more preferred that a premix carrier, which is a developer obtained by mixing the replenishment carrier with part of the replenishment toner, be loaded and then the replenishment toner be loaded.

The toner for use in the present embodiment will be described below in greater detail.

The replenishment toner comprises at least a binder resin and a colorant and, if necessary, contains a parting agent, a charge controlling agent, and other components. Furthermore, a flowability enhancing agent or other components may be added as additives. Well-known materials can be used as the aforementioned components. The same components can be also used in the toner contained in the developer in the development device 4 prior to the replenishment.

Examples of suitable binder resins include polymers of monomers such as styrene, parachlorostyrene, vinyl toluene, vinyl chlorine, vinyl acetate, vinyl propionate, methyl (meth) acrylate, ethyl(meth)acrylate, propyl(meth)acrylate, n-butyl (meth)acrylate, isobutyl(meth)acrylate, dodecyl (meth)acrylate, 2-ethylhexyl(meth)acrylate, lauryl (meth)acrylate, 2-hydroxyethyl(meth)acrylate, hydroxypropyl (meth)acrylate, 2-chloroethyl(meth)acrylate, (meth)acrylonitrilic acid, (meth)acrylamide, (meth)acrylic acid, vinyl methyl ether, vinyl ethyl ether, vinyl isobutyl ether, vinyl methyl ketone, N-vinyl pyrrolidone, N-vinyl pyridine, and butadiene, or copolymers of two or more such monomers, or mixtures thereof. Further, a polyester resin, a polyol resin, a polyurethane resin, a polyamide resin, an epoxy resin, rosin, modified rosin, a terpene resin, a phenolic resin, a hydrogenated petroleum resin, an ionomer resin, a silicone resin, a ketone resin, a xylene resin, etc., can be used individually or in a mixture.

All well-known dyes and pigments can be used as the colorant, examples thereof including carbon black, nigrosine dyes, iron black, Naphthol Yellow S, Hanza Yellow (10G, 5G, G), cadmium yellow, yellow iron oxide, ocher, lead yellow, titanium yellow, polyazo yellow, oil yellow, Hanza Yellow (GR, A, RN, R), Pigment Yellow L, Benzidine Yellow (G, GR), Permanent Yellow (NCG), Balkan Fast Yellow (5G, R), Tartrazine Lake, Quinoline Yellow Lake, Anthrazane Yellow BGL, Isoindolinone Yellow, iron oxide red, lead vermillion, led scarlet, cadmium red, cadmium mercury red, antimony vermillion, Permanent Red 4R, para red, Phiser Red, parachloro-orthonitroaniline red, Resol Fast Scarlet G, Brilliant Fast Scarlet, Brilliant Carmine BS, Permanent Red (F2R, F4R, FRL, FRLL, F4RH), Fast Scarlet VD, Balkan Fast Rubin B, Brilliant Scarlet G, Resol Rubin GX, Permanent Red F5R, Brilliant Carmine 6B, Pigment Scarlet 3B, Bordeaux 5B, Toluidine Maroon, Permanent Bordeaux F2K, Hellio Bordeaux BL, Bordeaux 10B, Bon Maroon Light, Bon Maroon Medium, eosin lake, Rhodamine Lake B, Rhodamine Lake Y, Alizaline Lake, thioindigo red B, thoindigo maroon, oil red, quinacridone red, pyrazolone red, polyazo red, chromium vermilion, benzidine orange, perinone orange, oil orange, cobalt blue, cellurian blue, alkali blue lake, peacock blue lake, Victoria blue lake, nonmetallic phthalocyanine blue, phthalocyanine blue, fast sky blue, Indanthrene Blue (RS, BC), indigo, ultramarine, Berlin Blue, anthraquinone blue, fast violet B, methyl violet lake, cobalt purple, manganese purple, dioxane violet, anthraquinone violet, chromium green, zinc green, chromium oxide, pyridian, emerald green, pigment green B, naphthol green B, green gold, acid green lake, Malachite green lake, phthalocyanine green, anthraquinone green, titanium oxide, zinc white, lithophone, and mixtures thereof. The amount of the colorant is generally 0.1 to 50 parts by weight to 100 parts by weight of the binder resin.

Examples of charge controlling agents include a nigrosine dye, a triphenylmethane dye, a chromium-containing metal complex dye, a molybdic acid chelate pigment, a rhodamine dye, an alkoxyamine, a quaternary ammonium salt (inclusive of fluorine-modified quaternary ammonium salts), an alkylamide, phosphorus or a compound thereof, tungsten or a compound thereof, a fluorine-containing active agent, a metal salicylate, and a metal salt of a salicylic acid derivative.

The amount of the charge controlling agent used in the developer is determined by the kind of the binder resin, the presence/absence of the additives that are added when necessary, and the toner production method inclusive of the dispersion method, and is not therefore uniquely restricted. Preferably, however, the amount used is within a range of 0.1 to 10 parts by weight per 100 parts by weight of the binder resin. A range of 2 to 5 parts by weight is more preferred. The amount of less than 0.1 parts by weight is impractical because the negative charge of the toner is insufficient. When the amount used exceeds 10 parts by weight, chargeability of the toner is too high, and the increase of the electrostatic attraction force with the carrier results in a decrease in developer flowability and causes decrease in image density.

Examples of suitable parting agents include low-molecular polyolefin waxes such as low-molecular polyethylene and low-molecular polypropylene, synthetic hydrocarbon waxes such as Fischer-Tropsch waxes, natural waxes such as bee wax, carnauba wax, candelilla wax, rice wax, and montane wax, petroleum waxes such as paraffin waxes and microcrystalline wax, higher fatty acids such as stearic acid, palmitic acid, and myristic acid, metal salts of higher fatty acids, and higher fatty acid amides, and various modified waxes thereof.

These agents can be used individually or in combinations of two or more thereof. A parting agent with a melting point within a range of 70 to 125° C. is preferred. Where the melting point is 70° C. or higher, a toner with excellent transfer ability and durability can be obtained. Where the melting point is 125° C. or less, the toner rapidly melts during fixing and a reliable parting effect can be demonstrated. The amount of the parting agent used is preferably 1 to 15 wt. % with respect to the toner. Where the amount used is less than 1 wt. %, the offset prevention effect is insufficient, and where the amount used is 15 wt. % or more, transferability and durability degrade.

Any conventional well-known flowability improving agents such as hydrophobic silica, tantalum oxide, silicon carbide, aluminum oxide, and barium titanate can be used individually or in a mixture thereof. From the standpoint of improving flowability, stabilizing the electric charge, and stabilizing the image quality, hydrophobic silica and titanium oxide are preferred. It is even more preferred that hydrophobic silica and titanium oxide be used in a combination because good toner with stabilized flowability and electric charging ability can be obtained. The amount of the flowability improving agent is 0.1 to 5 parts by weight, preferably 0.5 to 2 parts by weight per toner weight.

A typical conventional method by which materials constituting the toner are melted and kneaded, followed by powdering and classifying, can be used as a method for manufacturing the toner for use in the examples. However, this method is not limiting, and a variety of other methods, inclusive of a polymerization method, can be used.

Suitable polymerization methods include a suspension polymerization method, an emulsion polymerization method, and a dispersion polymerization method. Moreover, a dissolution suspension method, a polymer suspension method, and also an extension reaction method, which are different from the polymerization methods, can be also used.

The method for adding the additives to the toner to be used is not particularly limited, and examples of suitable methods include a method by which a toner mother particles and microparticles are mechanically mixed to cause the adhesion thereof by using one of various conventional mixers, and a method by which the toner mother particles and microparticles are homogeneously dispersed with a surfactant or the like in a liquid phase and subjected to adhesion treatment, followed by drying.

The weight-average particle size of the toner is preferably 3 to 12 μm. From the standpoint of improving the image quality, a range of 3 to 8 μm is especially preferred.

The carrier to be used in the examples will be described below in greater detail.

A replenishment carrier can be appropriately selected from well-known carriers according to the object. A carrier identical to that contained in the developer located in the development device 4 prior to the replenishment can be also used.

No particular limitation is placed on the core material and it can be appropriately selected from the well-known materials. For example, manganese-strontium (Mn—Sr) materials and manganese-magnesium (Mn—Mg) materials with 50 to 90 emu/g are preferred. From the standpoint of ensuring the image density, materials with a high degree of magnetization such as an iron powder (100 emu/g or more) and magnetite (75 to 120 emu/g) are preferred. From the standpoint of weakening the impact of the toner on the charged photosensitive body and increasing the image quality, nonmagnetic materials such as copper-zinc (Cu—Zn) materials (30 to 80 emu/g) are preferred. These materials may be used individually or in combination of two or more thereof.

No particular limitation is placed on the material of the resin layer and it can be appropriately selected from among well-known resins according to the object. Examples of suitable materials include amino resins, polyvinyl resins, polystyrene resins, halogenated olefin resins, polyester resins, polycarbonate resins, polyethylene resin, polyvinyl fluoride resin, polyvinylidene fluoride resin, polytrifluoroethylene resin, polyhexafluoropropylene resin, a copolymer of vinylidene fluoride and acryl monomer, a copolymer of vinylidene fluoride and vinyl fluoride, and fluoroterpolymers such as terpolymers of tetrafluoroethylene, vinylidene fluoride, and a non-fluorinated monomer, and silicone resins. These resins may be used individually or in combination of two or more thereof.

If necessary, the resin layer may contain an electrically conductive powder or the like. Examples of suitable electrically conductive powders include metal powders, carbon black, titanium oxide, tin oxide, and zinc oxide. The mean particle size of the electrically conductive powders is preferably 1 μm or less. Where, the mean particle size is more than 1 μm, the electric resistance can be difficult to control.

The resin layer can be formed, for example, by dissolving a silicone resin or the like in a solvent to prepare a coating solution, uniformly coating the coating solution on the surface of the above-described core by the well-known coating method, drying, and then baking. Examples of suitable coating methods include a dipping method, a spraying method and a brush coating method.

The amount of the coating layer in the carrier is preferably 0.01 to 5.0 wt. %. Where this amount is less than 0.01 wt. %, a uniform resin layer is sometimes impossible to form on the surface of the core material. Where the amount is more than 5.0 wt. %, the resin layer becomes excessively thick, the carrier granules are formed, and uniform carrier particles cannot be obtained. The mean particle size of the carrier is preferably 20 to 100 μm. In particular, in order to obtain high image quality, it is preferred that the mean particle size of the carrier be 20 to 45 μm.

The premix toner Tp, which is a replenishment developer for use in the present embodiment, will be described below in greater detail.

The premix toner Tp is composed of the above-described replenishment toner and replenishment carrier, and it is especially preferred that the replenishment toner and carrier be identical to the toner and carrier for use in the developer in the development device 4. In this case, even when the premix toner Tp is supplied, the initial characteristics of the developer in the development device 4 can be easily maintained and variations in image quality can be suppressed.

The concentration of carrier in the premix toner Tp is preferably 1 to 30 wt. %, especially preferably 5 to 20 wt. %. When the carrier concentration is less than 1 wt. %, the effect of suppressing the developer degradation can hardly be demonstrated, and when the carrier concentration is above 30 wt. %, the amount of discharged developer is too high, thereby increasing the cost.

The carrier is not required to be dispersed uniformly in the toner.

The premix carrier, which is a developer in which the toner concentration used in the present embodiment is lower than that of the premix toner Tp, will be described below. The ratio of the toner and carrier in the premix carrier may be any within a range in which the carrier and toner are electrically charged and the toner adheres to the carrier surface, but the referred ratio, as described above, is such that the coverage ratio is within a range of 10 to 200%.

Furthermore, the carrier and developer identical to the premix carrier and the developer in the development device may be also used. By using the mixture with the same ratio of toner and carrier, it is possible to employ a single process of mixing the developer. The carrier concentration in the developer in the development device is 90-98 wt. %, more preferably 93 to 97 wt. %. A well-known mixer can be used for mixing the developer.

[Test]

A test performed to compare the examples of the present invention and comparative examples will be described below.

The present invention is not limited to the below-described examples.

The replenishment developer accommodating containers A to E were prepared as the loaded toner bottles 120 for examples and comparative examples. The concentration of carrier in the vicinity of the toner discharge port 122 of the toner bottle 120 and in the vicinity of the container bottom 126 and also the attachment state of the carrier and toner were measured in the following manner. The measurement results are shown in FIG. 9.

A total of 2±0.1 g premix toner Tp was sampled from the toner bottle 120 and the electric charge amount and carrier concentration were calculated by removing the toner from this agent by a blow-off method by using TB-200 manufactured by Toshiba Chemical Co., Ltd.

When the carrier is present in the premix toner Tp, where the absolute value of the electric charge amount is 2 μc/g or more, the toner and carrier can be considered to be electrostatically attached to each other. In Table 1, the reference symbol "○" indicates the case where the absolute value of the electric charge amount is 2 μc/g or more, and "x" indicates the case where the absolute value of the electric charge amount is less than 2 μc/g.

The premix toner Tp located in the vicinity of the toner discharge port 122 was sampled from the toner discharge port 122, and the premix toner Tp located in the vicinity of the container bottom 126 was sampled by opening a hole in the container bottom 126.

The replenishment developer accommodating container A shown in FIG. 9 will be described below.

A toner bottle 120 for a magenta toner of imagio P Toner Type C2 (manufactured by Ricoh Co., Ltd.) was prepared. A total of 90 g of the replenishment carrier Ca was loaded from the toner discharge port 122 and then 510 g of the replenishment toner To was loaded in a state where the toner discharge port 122 faced up, as shown in FIG. 8. In this case, the region in the toner bottle 120 that was the farthest from the toner discharge port 122 was in the vicinity of the container bottom 126. In the vicinity of the container bottom 126, a layer was formed that contained only the carrier. The concentration of carrier in the premix toner Tp in the vicinity of the toner discharge port 122 of the replenishment developer accommodating container A and in the vicinity of the container bottom 126 is shown in Table 1. The replenishment toner and replenishment carrier of the following compositions were used.

First, the toner will be described.

The constituent materials of the toner mother particles are presented below. The term "parts" in the description of the materials stands for parts by weight.

| | | |
|---|---|---|
| Binder resin | Polyester resin | 95 parts |
| Colorant | Naphthol magenta pigment | 5 parts |
| Parting agent | Carnauba wax | 5 parts |
| Charge controlling agent | Zirconium salicylate | 1 part |

The aforementioned basic constituent materials of the toner mother particles were loaded into a Henschel mixer MF20C/I type (manufactured by Mitsui Miike Kakoki KK), kneaded and mixed thoroughly, and then melt kneaded in a twin-screw extruder manufactured by Toshiba Machine Co., Ltd. and cooled. The toner mother particles were fabricated by conducting pulverization and classification to obtain a weight-average particle size (D4) of 5.5±0.5 μm and a ratio (D4/D1) of the weight-average particle size to the number average particle size (D1) of 1.15 to 1.20. The following additives were added to and mixed with 100 parts of the toner mother particles by using the Henschel mixer, thereby producing the toner.

The toner additives are described below. The term "parts" in the description of the materials stands for parts by weight.

| | |
|---|---|
| Hydrophobic silica (average primary particle size 120 nm) | 0.8 part |
| Hydrophobic silica (average primary particle size 20 nm) | 0.8 part |
| Titanium oxide (average primary particle size 15 nm) | 1.2 part |

The carrier will be described below.

The constituent materials of the carrier are described below. The term "parts" in the description of the materials stands for parts by weight.

| Core material: calcined ferrite powder $\{(MgO)_{1.8}(MnO)_{49.5}(Fe_2O_3)_{48.0}$: mean particle size 35 μm$\}$ | |
|---|---|
| Coat material: | |
| Acrylic resin solution (content of solids 50 wt. %) | 21 parts |
| Guanamine solution (content of solids 70 wt. %) | 6.4 parts |
| Alumina particles (0.3 μm, intrinsic resistance $10^{14}$ Ω · cm) | 7.6 parts |
| Silicone resin solution (content of solids 23 wt. %) | 65.0 parts |
| Aminosilane | 0.3 part |
| Toluene | 60 parts |
| Butyl cellosolve | 60 parts |

The above-described coat material was dispersed for 10 min in a homogenizer and a blend coat liquid of an acrylic resin and silicone resin containing alumina particles was obtained. The coat liquid was coated with a spin coater (manufactured by Okada Seiko Co., Ltd.) to obtain a film thickness of 0.15 μm and dried. The coated particles were calcined for 1 h at 150° C. in an electric furnace. A carrier was then obtained by classifying the cooled ferrite powder bulk through a sieve with a 106 μm mesh.

The replenishment developer accommodating container B shown in FIG. 9 will be described below.

A toner bottle 120 identical to that of the replenishment developer accommodating container A was prepared. The toner discharge port 122 was set to face up, and 102 g of the replenishment toner To and then 90 g of the replenishment carrier Ca were loaded therethrough. Then, 408 g of the replenishment toner To was loaded again. The toner and carrier were identical to those loaded into the replenishment developer accommodating container A.

Because the carrier sank into and mixed with the toner layer that was loaded in the very beginning when the carrier was loaded, there was no portion where only the carrier was present. The concentration of carrier in the premix toner Tp in the vicinity of the toner discharge port 122 of the replenishment developer accommodating container B and in the vicinity of the container bottom 126 is shown in Table 1.

The replenishment developer accommodating container C shown in FIG. 9 will be described below.

A toner bottle 120 identical to that of the replenishment developer accommodating container A was prepared. The toner discharge port 122 was set to face up, and 496 g of the replenishment toner To and then 90 g of the replenishment carrier Ca were loaded therethrough. The toner and carrier were identical to those loaded into the replenishment developer accommodating container A.

Part of the carrier sank into the toner layer that has been heretofore loaded, but practically the entire carrier was in the vicinity of the toner discharge port 122. The concentration of carrier in the premix toner Tp in the vicinity of the toner discharge port 122 of the replenishment developer accommodating container C and in the vicinity of the container bottom 126 is shown in Table 1.

The replenishment developer accommodating container D shown in FIG. 9 will be described below.

A toner bottle 120 identical to that of the replenishment developer accommodating container A was prepared. The toner discharge port 122 was set to face up, and 125.3 g of the premix carrier (a) and 494.7 g of the replenishment toner and were loaded therethrough. The premix carrier (a) was produced as described below, and the toner was identical to that loaded into the replenishment developer accommodating container A.

The concentration of carrier in the premix toner Tp in the vicinity of the toner discharge port 122 of the replenishment developer accommodating container D and in the vicinity of the container bottom 126 is shown in FIG. 9.

A method for producing the premix carrier (a) will be described below.

A total of 83.7 kg of a carrier (identical to that loaded into the replenishment developer accommodating container A) and 6.3 kg of a toner (identical to that loaded into the replenishment developer accommodating container A) were mixed using a Turbula Shaker Mixer T50A (manufactured by TURBULA Co.) as a mixer. The mixing produced a premix carrier (a) in which the carrier and toner were mixed homogeneously without separation. The coverage ratio of the carrier with the toner in the premix carrier (a) was 10.1%.

The replenishment developer accommodating container E shown in FIG. 9 will be described below.

A toner bottle 120 identical to that of the replenishment developer accommodating container A was prepared. The toner discharge port 122 was set to face up, and 61.8 g of the premix carrier (b) and 513.2 g of the replenishment toner To and were loaded therethrough. The premix carrier (b) was produced as described below, and the toner was identical to that loaded into the replenishment developer accommodating container A.

The concentration of carrier in the vicinity of the toner discharge port 122 of the replenishment developer accommodating container E and in the vicinity of the container bottom 126 is shown in FIG. 9.

A method for producing the premix carrier (b) will be described below.

A total of 186 kg of a carrier (identical to that loaded into the replenishment developer accommodating container A) and 14 kg of a toner (identical to that loaded into the replenishment developer accommodating container A) were mixed using the Turbula mixer. The mixing produced a premix carrier (b) in which the carrier and toner were mixed homogeneously without separation. The coverage ratio of the carrier with the toner in the premix carrier (b) was 49.7%.

Example 1 used in the present test will be described below.

The toner replenishment device of Ricoh copier imagio Neo C600 was modified to operate independently, the replenishment developer accommodating container A was set into the magenta unit thereof, and the carrier replenishment ability was evaluated. The replenishment developer accommodating container A was shaken 10 times in the vertical direction prior to setting.

The test method and a method for evaluating the test results will be described below.

The following test method and evaluation method were used to evaluate the carrier replenishment ability.

The setting were such that the suction pump of the toner replenishment device was driven in 2-sec cycles with a 1-min drive interval and a conveying screw of a sub-hopper was driven in 0.6-sec cycles with a 10-sec drive interval. A container for receiving the premix toner Tp was loaded below the replenishment port of the sub-hopper, and the replenished amount could be automatically measured. One replenishment developer accommodating container A was set into the toner replenishment device, the replenishment operation was started, and the replenishment was continued till the toner end was detected by the toner end sensor located in the sub-hopper and the drive was stopped.

The weight of the premix toner Tp remaining inside the replenishment developer accommodating container A could be confirmed by the difference between the amount of the loaded premix toner Tp and the amount discharged after the drive has been stopped. The weight of the carrier could be confirmed by the weight after the toner has been removed by blowing out the remaining premix toner Tp. No problems are associated with the replenishment ability if the remaining amount of the premix toner Tp is less than 20 g and the remaining amount of the carrier is within 10 wt. % of the predetermined amount of the loaded carrier.

The premix toner Tp was sampled in the discharge process when the amount of the discharged toner was $Q/4\pm10$ g and $3Q/4\pm10$ g, where Q is the amount of the loaded premix toner Tp, and the carrier concentration and the electric charge carried by the discharged premix toner Tp were measured. The attachment state of the carrier and toner can be determined based on the amount of carried electric charge, and the dispersion state of the carrier can be confirmed from the carrier concentration.

The results obtained in evaluating the carrier replenishment ability are shown in FIG. 10.

As shown in FIG. 10, in Example 1, no carrier was discharged immediately after the replenishment was started, and the amount of discharged carrier was small in relation to carrier concentration during discharge even after a quarter of the amount of discharged. However, the amount of carrier increased thereafter and an especially large amount of the carrier remained in the toner bottle 120 after the discharged of the premix toner Tp ended.

A test method and an evaluation method for evaluating the multiple sheet output were as follows.

The modified Ricoh copier imagio Neo C600 was used. The modification was such that the developer inside the development device was discharged from the development device according to the inner volume thereof, and the discharged developer was recovered.

The replenishment developer accommodating container A that was shaken 10 times in the vertical direction was set into the toner replenishment device, 450 g of the developer of the same composition as the above-described premix carrier (b) was loaded into the development device, and 100,000 A4 magenta images with the image surface area ratio of 5% were continuously outputted. During the image output, the replenishment developer accommodating container A was replaced with the new container when the toner end was detected and the out was stopper. At this time, the replenishment developer accommodating container A was shaken 10 times in the vertical direction.

The following evaluation was performed before and after the continuous output. A problem-free image was decided to be obtained when each evaluation item had a rank of 3 or higher. The deterioration of the developer was determined to be inhibited when the evaluation items after the 100,000 output were not more than two ranks worse than the initial ones.

The results obtained in evaluating the multiple sheet output are shown in FIG. 11.

In Example 1, the decrease in image quality within the interval of replenishing one toner bottle 120 was inhibited, although a spread in the carrier replenishment amount was observed.

Evaluation criteria for each item shown in FIG. 11 will be explained below.

The following method was used for evaluating the image density.

A solid 1 inch×1 inch image was outputted in four corner locations (a paper margin of 2±0.5 cm was left) and in one central zone of PPC paper (type 6200, A4) manufactured by Ricoh Co., Ltd., and the image density in these five points was measured. The image density was measured with a spectrometer (manufactured by X-Rite Co, 938 Spectrodensitometer). A problem-free image density is obtained if the average value is 1.2 or more.

The criteria of ranks shown in FIG. 11 are presented below.

Rank 5 . . . Image density 1.4 or more.
Rank 4 . . . Image density 1.3 to 1.4.
Rank 3 . . . Image density 1.2 to 1.3.
Rank 2 . . . Image density 1.1 to 1.2.
Rank 1 . . . Image density less than 1.1.

A method for evaluating the background staining is described below.

A white solid image was outputted on the PPC paper (type 6200, A4) manufactured by Ricoh Co., Ltd., and the image density was measured in the same five locations as in the evaluation of image density. The image density in the same five locations was also measured for white paper of the same type that did not pass through the device. The background staining was evaluated based on the average values obtained in each case. In the state without any background staining, the density of image is equal to that of the paper, and the higher is this density, the worse is the background staining. The allowed range is rank 3 or more.

The criteria of ranks shown in FIG. 11 are presented below. The ranks represent the increase with respect to the density of white paper that did not pass through the device.

Rank 5 . . . 0.002 or less.
Rank 4 . . . 0.002 to 0.005.
Rank 3 . . . 0.005 to 0.010.
Rank 2 . . . 0.010 to 0.020.
Rank 1 . . . more than 0.020.

A method for evaluating the transferability is described below.

In the process of outputting an image in which 1 inch×1 inch solid black portions are arranged in a 4 column×4 row matrix in which the background portions are located between the columns and rows, the device is forcibly stopped to obtain a state in which solid portions prior to transfer are present on the photosensitive body and solid portions after the transfer are present on the transfer belt. The transfer ratio is calculated from the beta portions before and after the transfer by the amount of adhered toner. The amount of adhered toner is a value obtained by transferring the toner of the solid portions onto a tape and subtracting the weight before the tape transfer from the weight after the tape transfer.

Transfer ratio (%)=(Amount of adhered toner in the solid portion after the transfer (mg))/(Amount of adhered toner in the solid portion before the transfer (mg))×100.

The allowed range for ranks of transferability is rank 3 or more.

Rank 5 . . . 95% or more.
Rank 4 . . . 92.5 to 95%.
Rank 3 . . . 90 to 92.5%.
Rank 2 . . . 85 to 90%.
Rank 1 . . . less than 85%.

Example 2 used in the present test will be described below.

In Example 2, the test was carrier out and the evaluation of the carrier replenishment ability and multiple sheet output was performed by the same methods as in Example 1, except that the replenishment developer accommodating container B was used instead for the replenishment developer accommodating container A.

As shown in FIG. 10, no carrier was discharged immediately after the discharge was started, but because the carrier and toner were electrically charged and attached to each other, the carrier could be easily dispersed and the carrier concentration close to the carrier loading ratio was reached faster than in Example 1. Further, the spread in the carrier replenishment amount was small. With such loaded toner bottle 120, practically not degradation of image quality was observed even after multiple sheet output.

Comparative Example 1 used in the present test will be described below.

In Comparative Example 1, the test was carried out and the evaluation of the carrier replenishment ability and multiple sheet output was performed by the same methods as in Example 1, except that the replenishment developer accommodating container C was used instead for the replenishment developer accommodating container A.

The toner bottle 120 was shaken before installation, but a state in which the carrier concentration was substantially higher than the carrier loading ratio was maintained from the start of discharging process. For this reason, from a certain intermediate stage, a state was assumed in which the carrier concentration was, conversely, rather low. With the toner bottle 120 having such a large spread, the image quality decreased significantly after the multiple sheet output.

Example 3 used in the present test will be described below.

In Example 2, the replenishment developer accommodating container B was shaken before installation into the replenishment device, but in the present example, the container was installed without shaking. The test was then performed by the same method as in Example 2, and the carrier replenishment ability and multiple sheet output were evaluated.

As shown in FIG. 11, the evaluation results were inferior to those of Example 2, but the deterioration of image quality after multiple sheet output was suppressed. Example 3 confirmed that with the replenishment developer accommodating container B, the deterioration of image quality after multiple sheet output could be reduced even when the toner bottle 120 was installed without shaking.

Comparative Example 2 used in the present test will be described below.

In Comparative Example 1, the replenishment developer accommodating container C was shaken before installation into the replenishment device, but in the present comparative example, the container was installed without shaking. The test was then performed by the same method as in Comparative Example 1, and the carrier replenishment ability and multiple sheet output were evaluated.

In Comparative Example 2, practically the carrier alone was discharged after the replenishment is started and the replenishment device stopper immediately thereafter, The sub-hopper was clogged with the carrier, and the premix toner Tp was not supplied to the development device. As a result, the multiple sheet output evaluation was impossible.

Example 4 used in the present test will be described below.

In Example 4, the test was performed by the same method and the carrier replenishment ability and multiple sheet output were evaluated by the same methods as in Example 3, except that the replenishment developer accommodating container D was used instead of the replenishment developer accommodating container B.

In Example 4, the carrier loading ratio was higher than in Example 1 and the toner bottle 120 was not shaken before installation, but because the toner bottle 120 was filled with the premix carrier, which is a developer obtained by mixing the carrier and toner, although the carrier replenishment amount was small for some time after the replenishment was started, the subsequent spread was small and the carrier concentration did not increase critically with respect to the carrier loading ratio. Furthermore, the amount of carrier remaining in the toner bottle 120 was smaller than that in Example 1.

Example 5 used in the present test will be described below.

In Example 5, the test was performed by the same method and the carrier replenishment ability and multiple sheet output were evaluated by the same methods as in Example 3, except that the replenishment developer accommodating container E was used instead of the replenishment developer accommodating container B.

The spread in the carrier replenishment amount was decreased by increasing the toner coverage ratio on the carrier with respect to that in Example 4. Further, the carrier loading ratio was lower than that in Examples 1 to 4, but the image quality after multiple sheet output practically did not degrade.

With the above-described embodiment, when the premix toner Tp, which is a replenishment developer composed of the replenishment toner To and replenishment carrier Ca, is loaded into the toner bottle 120, which is the developer accommodating container, the replenishment carrier Ca is loaded and the replenishment toner To is then loaded, thereby making it possible to load the premix toner Tp into the toner bottle 120 in a state in which the premix toner Tp present in the vicinity of the toner discharge port 122, which is the developer discharge port of the toner bottle 120 after the premix toner Tp has been loaded is not composed only of the carrier. Therefore, the premix toner Tp present in the vicinity of the toner discharge port 122 becomes either the developer composed of the toner and the carrier, or the toner, and the developer composed of the toner and carrier, or the toner can be discharged from the toner discharge port 122 of the toner bottle 120 when the replenishment of the premix toner Tp using the toner bottle is started.

Further, where the replenishment carrier Ca is loaded and then the replenishment toner To is loaded when the premix toner Tp is loaded into the toner bottle 120, the ratio of carrier container in the premix toner Tp present in the vicinity of the toner discharge port 122 decreases with respect to the ratio of carrier contained in the entire premix toner Tp accommodated in the toner accommodating body 121, which is the developer accommodating body. Thus, the premix toner Tp present in the vicinity of the toner discharge port 122 becomes only the toner or the developer with a carrier concentration lower than the average carrier concentration in the entire premix toner Tp. Where the toner and carrier are mixed homogeneously in the premix toner Tp in the toner bottle 120, the ratio of toner and carrier is determined so that the premix toner can be conveyed with the toner pump 60, which is a powder pump. Therefore, when the developer with a carrier concentration lower than the average carrier concentration of the entire premix toner Tp is discharged from the toner bottle 120, it can be conveyed without any problem by the toner pump 60 to the development device 4. Further, even when the toner alone is discharged, it can be conveyed without any problem by the toner pump 60 to the development device 4.

Further, where the replenishment carrier Ca is loaded and then the replenishment toner To is loaded when the premix toner Tp is loaded into the toner bottle 120, the ratio of carrier contained in the premix toner Tp present in the vicinity of the toner discharge port 122 decreases with respect to the ratio of carrier contained in the premix toner Tp present in the vicinity of the container bottom 126, which is the region that is the farthest from the toner discharge port 122 inside the toner bottle 120. In this case, even if the premix toner Tp present in the vicinity of the container bottom 126 container only the carrier, because the carrier concentration in the vicinity of the toner discharge port 122 is lower than that in the vicinity of the container bottom 126, the toner alone or the developer containing the toner and carrier is present in the vicinity of the toner discharge port 122. Therefore, when the replenishment of the premix toner Tp using the toner bottle 120 is started, the developer containing the toner and carrier, or the toner can be discharged from the toner discharge port of 122 the toner bottle 120.

When the replenishment carrier is loaded into the toner bottle 120, the carrier can be mixed in advance with part of the toner by loading the premix carrier that is a developer containing the toner and carrier with a toner content ratio lower than that of the premix toner Tp and then loading this premix carrier and the toner containing no carrier into the toner bottle 120. As a result, the carrier in the premix carrier and the toner are electrically charged, and the presence of the carrier that is not covered with the toner can be prevented before the replenishment of the toner bottle 120 is started. Therefore, the discharge of carrier alone from the toner discharge port 122 of the toner bottle 120 is prevented.

The presence of the carrier that is not covered with the toner is also prevented by setting the toner coverage ratio of the carrier contained in the premix carrier to 25% or more. By setting the toner coverage ratio of the carrier contained in the premix carrier to 100% or less, it is possible to prevent the uneven distribution of the carrier in the mixer caused by the increase in the amount of toner that cannot be attached to the carrier.

By loading the premix carrier and then loading the replenishment toner To when the premix toner Tp is loaded into the toner bottle 120, it is possible to load into the toner bottle 120 the premix toner Tp in a state in which the premix toner Tp present in the vicinity of the toner discharge port 122, which is the developer discharge port of the toner bottle 120 after the premix toner Tp has been loaded, is not composed of the carrier alone. Therefore, the premix toner Tp present in the vicinity of the toner discharge port 122 becomes a developer containing the toner and carrier, or the toner, and the developer containing the toner and carrier, or the toner can be discharged from the toner discharge port 122 of the toner bottle 120 when the replenishment of the premix toner Tp using the toner bottle is started. In addition, where the premix carrier is loaded, the carrier that is not covered with the toner can hardly be present. Therefore, even when the amount of premix toner Tp remaining inside the toner bottle 120 has decreased, the state in which the carrier alone is present inside the toner bottle 120 can be prevented. As a result, the amount of the carrier remaining inside the toner bottle 120 after the replenishment is ended can be decreased.

By loading the premix carrier and then loading the replenishment toner To, it is possible to prevent a state in which the carrier alone is discharged from the toner discharge port 122 when the replenishment using the toner bottle 120 is started, if the loaded toner bottle 120 is used that is a developer accommodating container loaded with the premix toner Tp.

Moreover, by loading the premix carrier and then loading the replenishment toner To, it is possible to prevent a state in which the entire carrier located in the toner bottle 120 is discharged and the toner alone remains inside the toner bottle 120. Where the entire premix carrier is discharged by the toner discharge port 122 when the toner bottle 120 is set, the entire premix carrier is discharged and only the toner remains in the toner bottle. When such state is assumed, in the development device 4 in which the developer is successively discharged from the development device 4 by the above-described variation in the amount of developer, although the carrier is discharged from inside the development device 4, it cannot be replenished, and a carrier deficiency occurs in the development device 4. On the other hand, when the premix carrier is loaded and then the replenishment toner To is loaded, the carrier that has a specific gravity higher than that of the toner moves down toward the toner discharge port 122 while being dispersed, during the replenishment operation to the development device 4 after setting. Therefore, the replenishment of the carrier inside the development device 4 can be performed intermittently, and the above-described problem associated with the occurrence of carrier deficiency inside the development device 4 when the entire carrier is replenished can be prevented.

Further, by configuring the toner accommodating body 121 of the toner bottle 120 as a substantially sealed and deformable body and decreasing the volume of the toner accommodating body 121 by discharging the premix toner Tp to the outside, it is possible to roll up and recover the used toner bottle 120. As a result, the primary storage space for the used toner bottles 120 can be decreased and the transportation cost during recovery can be reduced. Further, with such deformable toner bottle 120, no agitating member can be provided inside the toner accommodating body 121. Therefore, with certain methods for loading the premix toner Tp, the carrier alone can be discharged when the replenishment is started. However, when the premix carrier is loaded and then the replenishment toner To is loaded, as in the present embodiment, it is possible to prevent a state in which the carrier alone is discharged from the toner discharge port 122 when the replenishment using the toner bottle 120 is started, provided that the loaded toner bottle 120 is loaded with the premix toner Tp.

Further, when the toner bottle 120 is installed into the toner replenishment device 500, which is a developer replenishment device, where the toner bottle is so installed that the toner discharge port 122 is in the lowermost portion, as shown in FIGS. 5, 6, and 7, the premix toner Tp inside the toner bottle 120 is discharged from below. As a result, the movement of the premix toner Tp inside the toner bottle 120 that accompanies the discharge of the premix toner Tp is facilitated. Further, the carrier that has a specific gravity higher than that of the toner will be easily transferred in the direction of the toner discharge port 122. As a result, where the replenishment carrier Ca is loaded first when the premix toner Tp is loaded, the carrier that is concentrated in the vicinity of the container bottom 126 is gradually dispersed, the carrier is discharged together with the toner, and the carrier hardly remains inside the toner bottle 120.

Further, it is preferred that the toner and carrier inside the toner bottle 120 be electrically charged and electrostatically attached to each other. Where they are present in such a state, the toner is hardly separated from the carrier surface, and the surrounding toner is easily attached to the carrier by electrostatic forces, thereby preventing the carrier particles from aggregating. As a result, a state in which the carrier alone is discharged from the toner discharge port 122 can be prevented.

By loading the developer accommodating container of the toner replenishment device 500, which is a developer replenishment device, with the carrier and then with the replenishment toner To, it is possible to prevent a state in which the carrier alone is discharged from the toner discharge port 122 when the replenishment using the toner bottle 120 is started, provided that the loaded toner bottle 120 is loaded with the premix toner Tp. Because a state in which the carrier alone is discharged when the replenishment is started can be prevented, the clogging with the carrier can be prevented from making the conveyance impossible even in the case of a configuration in which the premix toner Tp is conveyed by a negative pressure of the toner pump 60, which is a powder pump.

Further, where the copier serving as an image forming apparatus uses a toner replenishment device 500 as a developer replenishment means, the premix toner Tp can be supplied into the development device 4 with good stability. Therefore, stable image formation can be performed.

Concerning a method for manufacturing the toner bottle 120, which is a loaded developer accommodating container, by loading the carrier and then loading the replenishment toner To, it is possible to prevent a state in which the carrier alone is discharged from the toner discharge port 122 when the replenishment using the toner bottle 120 is started, provided that the loaded toner bottle 120 is loaded with the premix toner Tp.

In accordance with the present invention described hereinabove, the following excellent effect is obtained. Thus, because, the replenishment toner present in the vicinity of the developer discharge port of the loaded developer accommodating container is the developer containing a toner and a carrier, or the toner, when the replenishment of the replenishment developer using the developer accommodating container is started, the developer containing the toner and carrier, or the toner can be discharged from the developer discharge port of the developer accommodating container.

Further, in the present invention, the replenishment developer is loaded into the developer accommodating container in a state in which the replenishment developer present in the vicinity of the developer discharge port of the developer accommodating container after the replenishment developer has been loaded does not contain only the carrier. Therefore, the replenishment developer present in the vicinity of the developer discharge port is a developer containing the toner and carrier, or the toner.

Various modifications will become possible for those skilled in the art after receiving the teachings of the present disclosure without departing from the scope thereof.

What is claimed is:

1. A developer loading method for loading a replenishment developer comprising a toner and a carrier into a developer accommodating container which is used in a developer replenishment device for conveying a developer by an attraction force and which has: a developer accommodating body that accommodates the replenishment developer; and a developer discharge port for discharging the replenishment developer from inside the developer accommodating body to the outside, the method comprising:

loading the carrier into the developer accommodating body through the developer discharge port; and loading the toner into the developer accommodating body through the developer discharge port after the carrier has been loaded through the developer discharge port, wherein a premix carrier that is a developer comprising the toner and the carrier is loaded when the carrier is loaded into the developer accommodating container, and the replenishment developer is loaded into the developer accommodating container by loading respectively the toner and the premix carrier into the developer accommodating container.

2. The developer loading method according to claim 1, wherein the replenishment developer is loaded into the developer accommodating container so that the ratio of the carrier in the replenishment developer located in the vicinity of the developer discharge port is smaller than the ratio of the carrier in the entire replenishment developer that is accommodated in the developer accommodating body.

3. The developer loading method according to claim 1, wherein the replenishment developer is loaded into the developer accommodating container so that the ratio of the carrier in the replenishment developer located in the vicinity of the developer discharge port is smaller than the ratio of the carrier in the replenishment developer that is present in the region farthest from the developer discharge port inside the developer accommodating container.

4. The developer loading method according to claim 1, wherein the coverage ratio of the carrier with the toner in the premix carrier is from 25% to 100%.

5. The developer loading method according to claim 1, wherein the toner is loaded from the developer discharge port after the premix carrier has been loaded from the developer discharge port.

6. The developer loading method according to claim 1, wherein the replenishment developer is loaded into the developer accommodating container in a state in which the replenishment developer located in the vicinity of the developer discharge port of the developer accommodating container after the replenishment developer has been loaded is not composed only of the carrier, and so that the ratio of the carrier in the replenishment developer located in the vicinity of the developer discharge port is smaller than the ratio of the carrier in the entire replenishment developer that is accommodated in the developer accommodating body.

7. A loaded developer accommodating container which is used in a developer replenishment device for conveying a developer by an attraction force, and which comprises:

a developer accommodating body that is loaded with a replenishment developer comprising a toner and a carrier; and a developer discharge port for discharging the replenishment developer from inside the developer accommodating body to the outside, wherein the toner has been loaded from the developer discharge port after the carrier has been loaded from the developer discharge port, wherein a premix carrier that is a developer comprising the toner and the carrier has been loaded when the carrier was loaded into the developer accommodating container, and the replenishment developer has been loaded into the developer accommodating container by loading respectively the toner and the premix carrier into the developer accommodating container.

8. The loaded developer accommodating container according to claim 7, wherein the developer accommodating body is configured to be substantially tightly closed and deformable, and the volume of the developer accommodating body is decreased by discharging the replenishment developer to the outside.

9. The loaded developer accommodating container according to claim 7, wherein the shape of the loaded developer accommodating container is such that the developer discharge port is located in the lowermost part when the loaded developer accommodating container is installed in the developer replenishment device.

10. The loaded developer accommodating container according to claim 7, wherein the toner inside the developer accommodating body is electrostatically attached to the carrier.

11. The loaded developer accommodating container according to claim 7, wherein the coverage ratio of the carrier with the toner in the premix carrier is from 25% to 100%.

* * * * *